US005106067A

United States Patent [19]

Higaki

[11] Patent Number: 5,106,067

[45] Date of Patent: Apr. 21, 1992

[54] SORTER-FINISHER WITH A SHEET FINISHING FUNCTION

[75] Inventor: Masahiro Higaki, Osaka, Japan

[73] Assignee: Minolta Camera Kabushiki Kaisha, Osaka, Japan

[21] Appl. No.: 496,014

[22] Filed: Mar. 20, 1990

[30] Foreign Application Priority Data

Mar. 23, 1989 [JP] Japan ..... 1-73039
Mar. 23, 1989 [JP] Japan ..... 1-73040
Mar. 23, 1989 [JP] Japan ..... 1-73041

[51] Int. Cl.[5] ..... B42B 2/00
[52] U.S. Cl. ..... 270/53
[58] Field of Search ..... 270/37, 53, 56, 58; 271/3.1

[56] References Cited

U.S. PATENT DOCUMENTS 4,811,048 3/1989 Ishikawa et al. .
4,864,350 9/1989 Ishiguro et al. .

FOREIGN PATENT DOCUMENTS 21678 1/1987 Japan ..... 270/58
235260 9/1988 Japan ..... 270/37
34864 2/1989 Japan ..... 270/53
64974 3/1989 Japan ..... 270/58

*Primary Examiner*—Edward K. Look
*Assistant Examiner*—Therese M. Newholm
*Attorney, Agent, or Firm*—Burns, Doane, Swecker & Mathis

[57] ABSTRACT

A sorter having a finishing function which comprises a distributing unit for distributing printed sheets among a plurality of bins; a stapling unit for stapling the sheets; and a transporting unit for transporting the sheets from each bin to the stapling unit in a predetermined order. In the sorter, when a trouble occurs during the transportation of the sheets from one of the bins to the stapling unit, the transporting operation is discontinued, and when the trouble has been treated, the transporting operation is resumed with the bin next to the bin where the trouble occurred during the sheet transportation. Also, the sorter comprises sensors for detecting the existence of sheets in each bin, and when no sheets are detected in the bin where the trouble occurred during the sheet transportation, the transporting operation is resumed with the next bin, and when sheets are detected in the bin, the transporting operation is resumed with the bin.

16 Claims, 39 Drawing Sheets

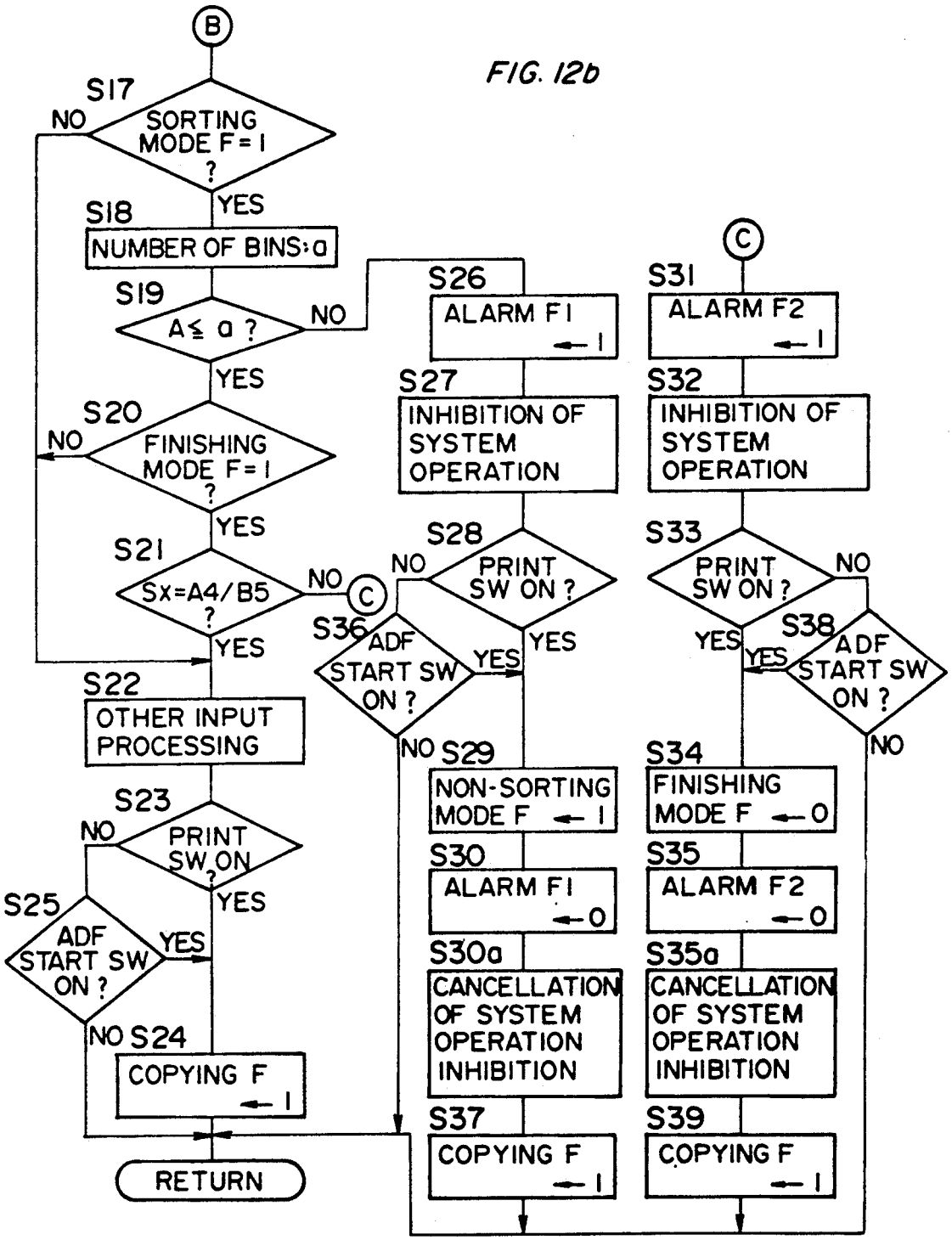
FIG. 12b
B
S17
SORTING MODE F=1 ?
NO
YES
S18
NUMBER OF BINS:a
S19
A≦a ?
NO
YES
S20
FINISHING MODE F=1 ?
NO
YES
S21
Sx=A4/B5 ?
NO
C
YES
S22
OTHER INPUT PROCESSING
S23
PRINT SW ON ?
NO
YES
S25
ADF START SW ON ?
YES
NO
S24
COPYING F ←1
RETURN
S26
ALARM F1 ←1
S27
INHIBITION OF SYSTEM OPERATION
S28
PRINT SW ON ?
NO
YES
S36
ADF START SW ON ?
YES
NO
S29
NON-SORTING MODE F ←1
S30
ALARM F1 ←0
S30a
CANCELLATION OF SYSTEM OPERATION INHIBITION
S37
COPYING F ←1
C
S31
ALARM F2 ←1
S32
INHIBITION OF SYSTEM OPERATION
S33
PRINT SW ON ?
NO
YES
S38
ADF START SW ON ?
YES
NO
S34
FINISHING MODE F ←0
S35
ALARM F2 ←0
S35a
CANCELLATION OF SYSTEM OPERATION INHIBITION
S39
COPYING F ←1

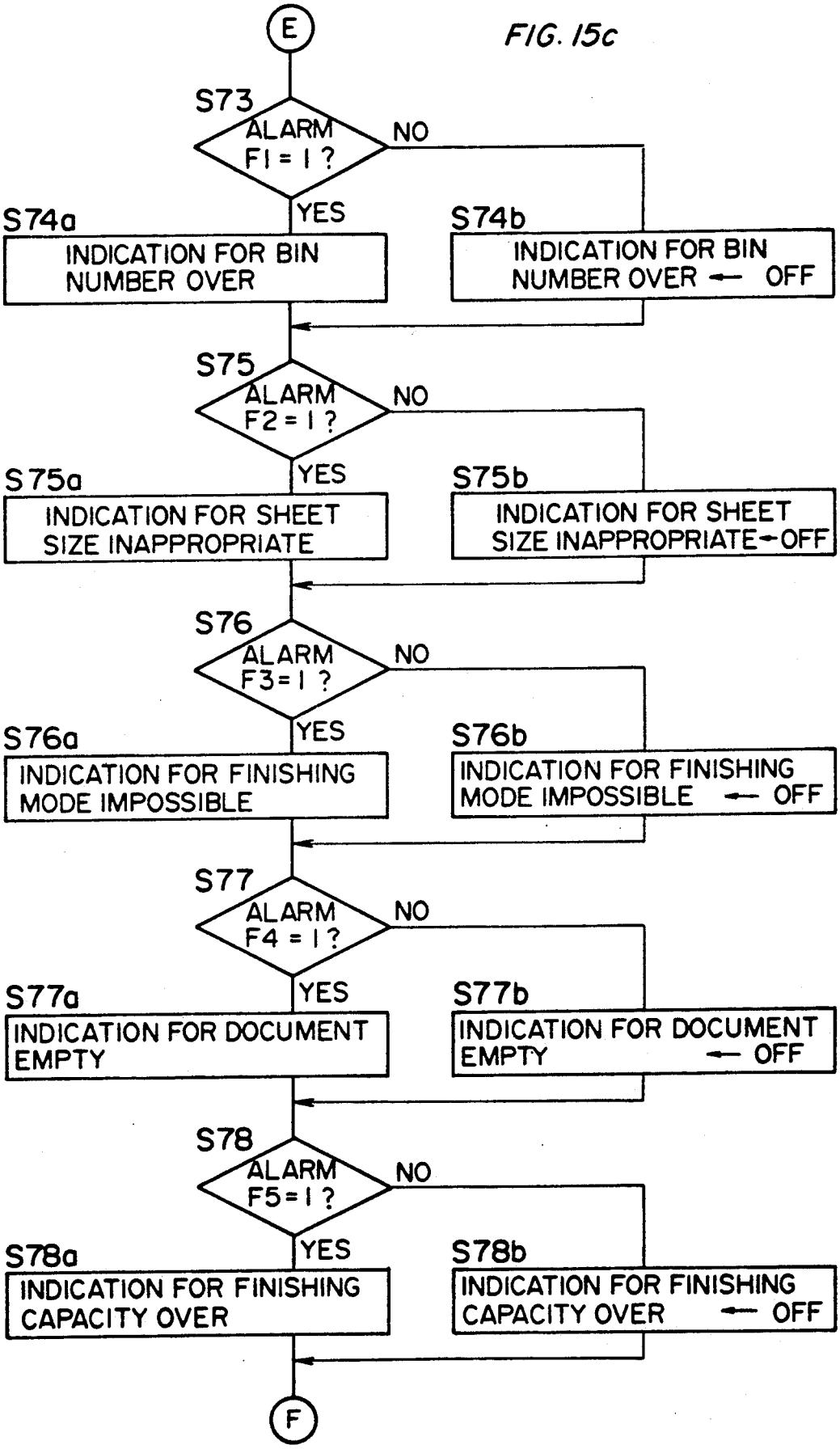
E
FIG. 15c
S73
ALARM F1 = 1 ?
NO
YES
S74a
INDICATION FOR BIN NUMBER OVER
S74b
INDICATION FOR BIN NUMBER OVER ← OFF
S75
ALARM F2 = 1 ?
NO
YES
S75a
INDICATION FOR SHEET SIZE INAPPROPRIATE
S75b
INDICATION FOR SHEET SIZE INAPPROPRIATE ← OFF
S76
ALARM F3 = 1 ?
NO
YES
S76a
INDICATION FOR FINISHING MODE IMPOSSIBLE
S76b
INDICATION FOR FINISHING MODE IMPOSSIBLE ← OFF
S77
ALARM F4 = 1 ?
NO
YES
S77a
INDICATION FOR DOCUMENT EMPTY
S77b
INDICATION FOR DOCUMENT EMPTY ← OFF
S78
ALARM F5 = 1 ?
NO
YES
S78a
INDICATION FOR FINISHING CAPACITY OVER
S78b
INDICATION FOR FINISHING CAPACITY OVER ← OFF
F

SORTER-FINISHER WITH A SHEET FINISHING FUNCTION

BACKGROUND OF THE INVENTION

1. Field of the Invention having a

The present invention relates to a sorter having a finishing function, and more particularly, to a sorter a finishing function wherein sheets ejected from a copying machine, a laser printer or the like are distributed in a plurality of bins and bound by a stapler or the like.

2. Description of Related Art

Recently, responding to the increasing demand for automated paper handling systems for copying machines, optional systems such as an automatic document feeding system and a sorting system designed for sorting or grouping copied sheets have been developed and commercialized in various types. The users of the copying machines are now requiring a sorter-finisher capable of automatically binding and stacking sheets. By request, a sorter-finisher having simple construction was disclosed by U.S. Pat. No. 4,811,048.

Incidentally, in such a sorter-finisher wherein sheets stored in the bins are automatically taken out thereof and transported to the staple tray to be stapled, it is an issue how to control the mechanism when a trouble such as a paper jam occurs during the sheet transportation from each of the bins to the staple tray. Generally when such a trouble occurs, an operator takes the sheets out of the bin where the trouble occurred. However, if the finisher-sorter is so constituted that after treatment of the trouble, the operation is resumed with the bin where the trouble occurred, the operation may be discontinued again because there are no sheets in the bin, and the operation is never proceeding.

Also, the sheets in the bin where a trouble occurred are not always taken out thereof by an operator, and the sheets are sometimes set in the bin again. Accordingly, the sorter-finisher should have a proper control system so that the operation is resumed in a proper way, according to the way of treating the trouble, or the state of the bin where the trouble occurred.

Further, in such a sorter-finisher, a stapling operation is not prepared until it is confirmed that there are sheets in the bins of the sorter. Conventionally, a photosensor whose optical axis penetrates all the bins is provided for the sorter to check the existence of sheets. However, in this way of detecting sheets, if there are sheets in at least and one of the bins, the existence of sheets is confirmed. Therefore, even when the sheets are taken out of one of the bins, it is impossible to detect. It sometimes happens that sheets are taken out of a bin by an operator who is in a hurry so that the sheets will be stapled manually, and in such a case, when the bin where the sheets has taken out by the operator is to be subjected to the stapling operation, the occurrence of a trouble is judged, which causes discontinuance of the operation.

SUMMARY OF THE INVENTION

It is, therefore, an object of the present invention to provide a sorter having a finishing function which is convenient for operators.

Another object of the present invention is to provide a sorter having a finishing function wherein when a trouble occurs during transportation of sheets from a bin of the sorter to a processing unit such as a stapling unit, the operation is resumed after treatment of the trouble smoothly so that the operation can proceed to the succeeding bins smoothly.

Further, another object of the present invention is to provide a sorter having a finishing function wherein even when sheets are taken out of one of the bins during a finishing operation, it is detected and the operation proceeds, skipping the bin where sheets have been take out.

In order to attain the objects above, a sorter having a finishing function according to the present invention comprises means for distributing sheets ejected from an image forming apparatus among a plurality of bins; means for finishing the sheets delivered to each of the bins; means for transporting the sheets from each bin to the finishing means in a predetermined order; means for judging the occurrence of a trouble during the transportation of the sheets from each bin to the finishing means; means for discontinuing the operation of at least the transporting means when the occurrence of a trouble is judged; means for commanding the resumption of the transporting operation; and control means for, when the resumption command is generated, resuming the operation with the bin next to the bin where the trouble occurred during the sheet transportation With the arrangement above, while finishing processing such as stapling processing is performed, when it is judged that there is a trouble in transporting the sheets from a bin to the finishing means at least the operation of the transporting means is discontinued. Then, the trouble is treated by an operator, and thereafter the transporting operation is resumed with the bin next t the bin where the trouble occurred. With the control system, after treatment of a trouble, the operation is resumed with the next bin smoothly.

The control means of the sorter having a finishing function according to the present invention is operated either in a first mode where the transporting operation is resumed with the bin next to the bin where the trouble occurred during the sheet transportation, or in a second mode where the transporting operation is resumed with the bin where the trouble occurred during the sheet transportation, and preferably the sorter further comprises means for selecting the first mode or the second mode. When the resumption of the transporting operation is commanded after treatment of the trouble by an operator, the operator may select the first or the second mode with the selecting means to designate a first bin with which the operation is resumed. The selecting means may be disposed on the operation panel as a retry switch, and when the operator sets the sheets in the bin again, the second mode should be selected On the other hand, when the operator takes the sheets out of the bin, the first mode should be selected.

The sorter having a finishing function which comprises the sheet distributing means, the finishing means, the transporting means, the transport trouble judging means, the discontinuing means and the resumption commanding means further includes means for detecting the existence of sheets in each bin and control means for selecting the first mode or the second mode according to the output of the sheet detecting means. When it is judged that there are no sheets in the bin where the trouble occurred during the sheet transportation, which means that an operator took the sheets out of the bin, the first mode is automatically selected, and when it is judged that there are sheets in the bin where, which means that an operator set the sheets in the bin again, the second mode is automatically selected. With this arrangement, the operation is smoothly resumed.

The sorter having a finishing function which comprises the sheet distributing means, the finishing means, the transporting means and the sheet detecting means furthermore includes means for switching bins to subject the next bin to the sheet transporting operation and control means for controlling the bin switching means to subject the next bin to the sheet transporting operation when no sheets are detected in the current bin. Whereby, when the sheets are taken out of one of the bins during an operation, the bin is skipped and the next bin is immediately subjected to the sheet transporting operation, which may lead to improvement in processing speed and convenience.

BRIEF DESCRIPTION OF THE DRAWINGS

These and other objects and features of the present invention will become apparent from the following description taken in conjunction with the preferred embodiments thereof with reference to the accompanying drawings, in which.

Figure 6:
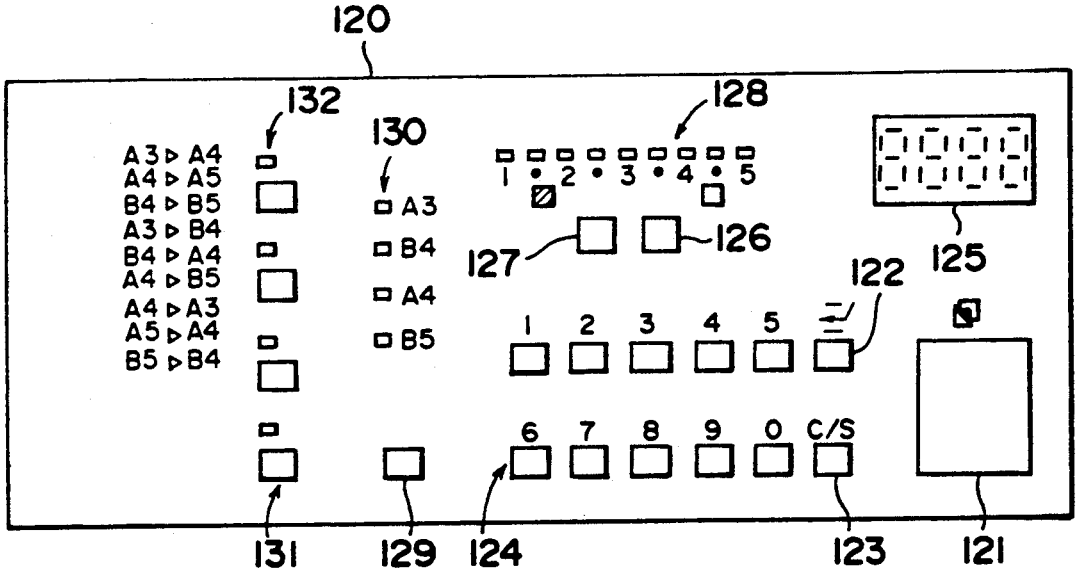
Figure 7:
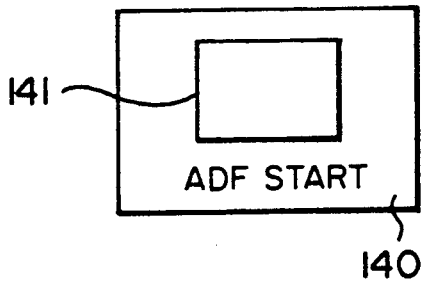
Figure 8:
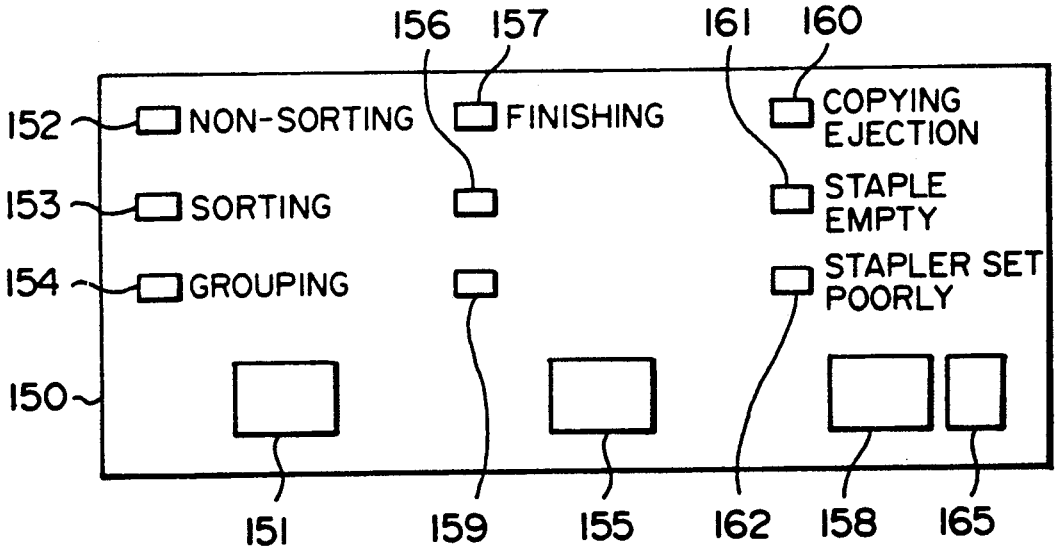
Figure 9:
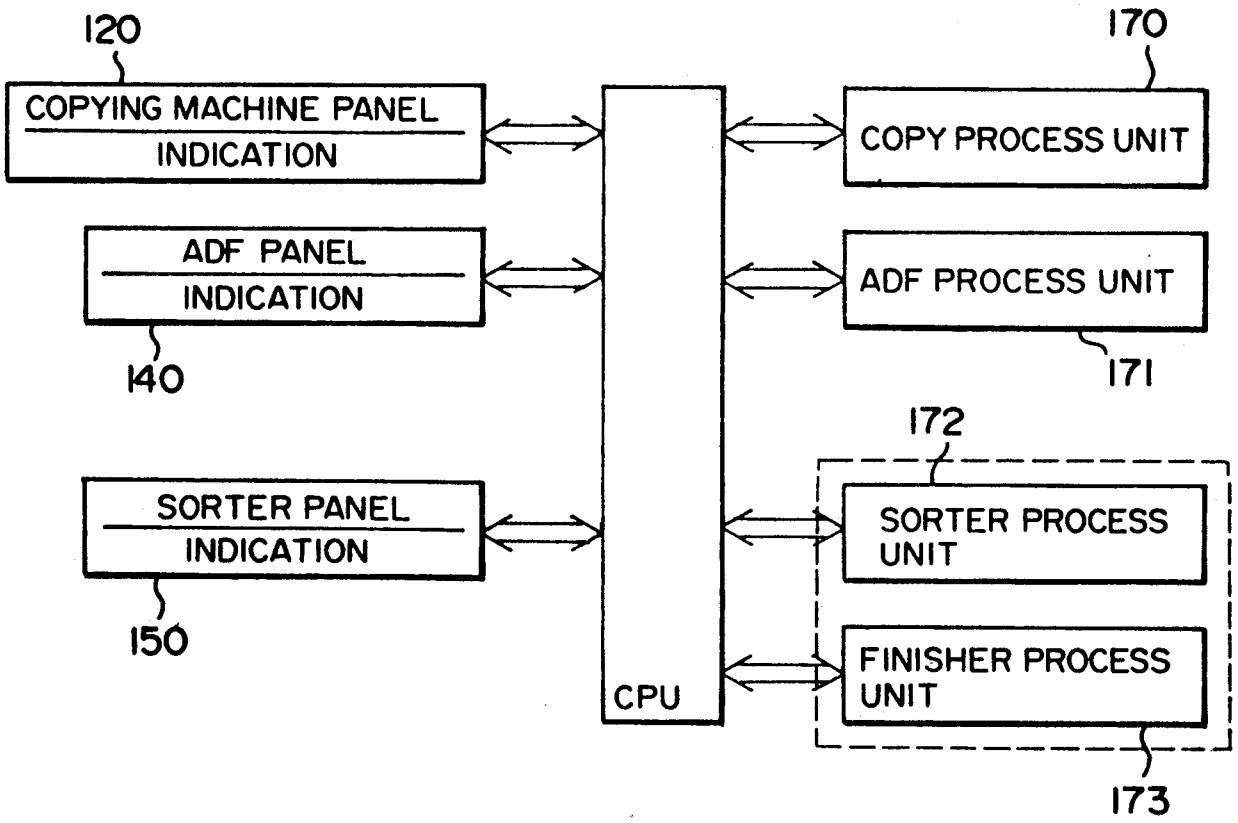
Figure 10:
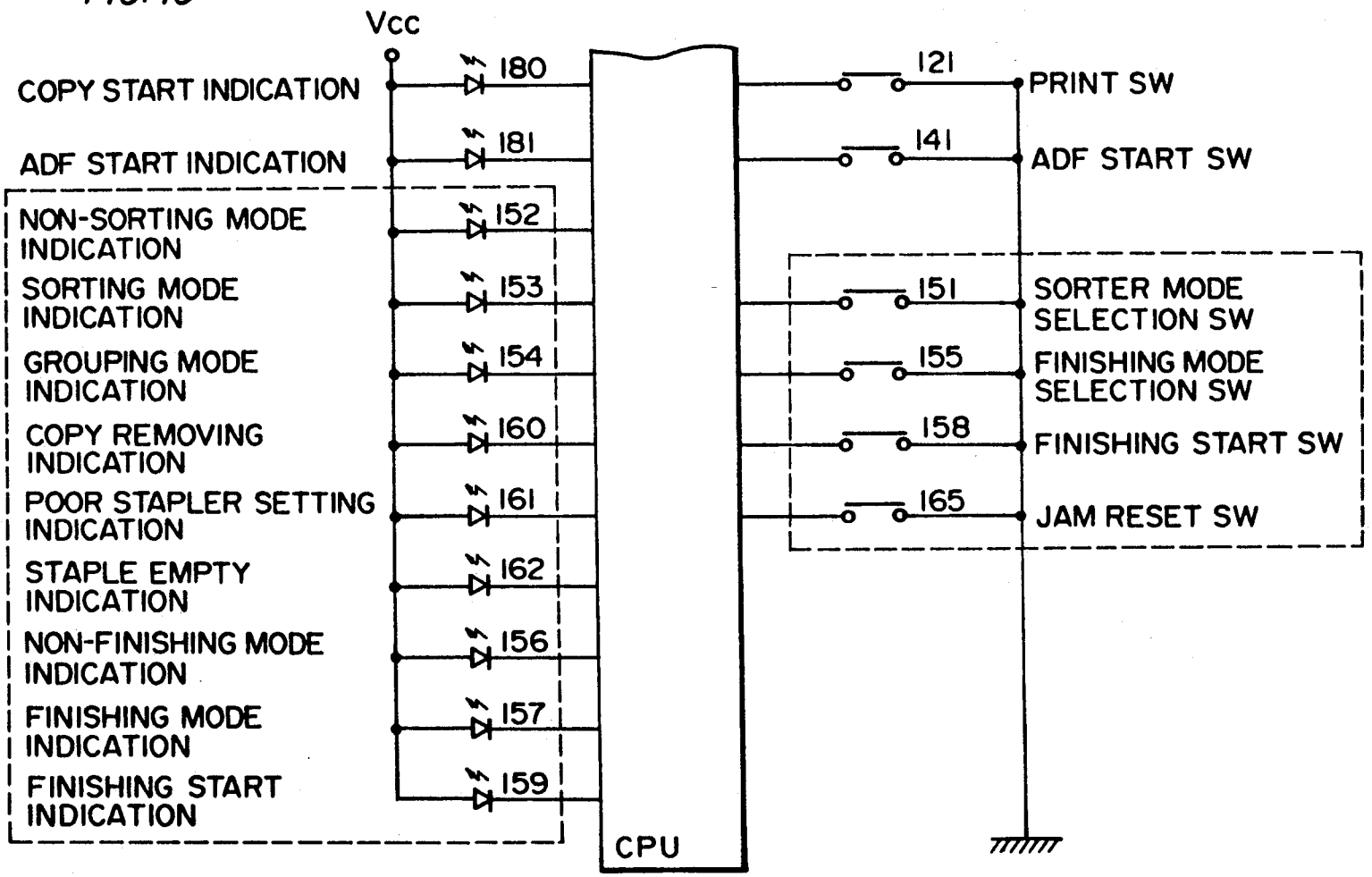
Figure 11:
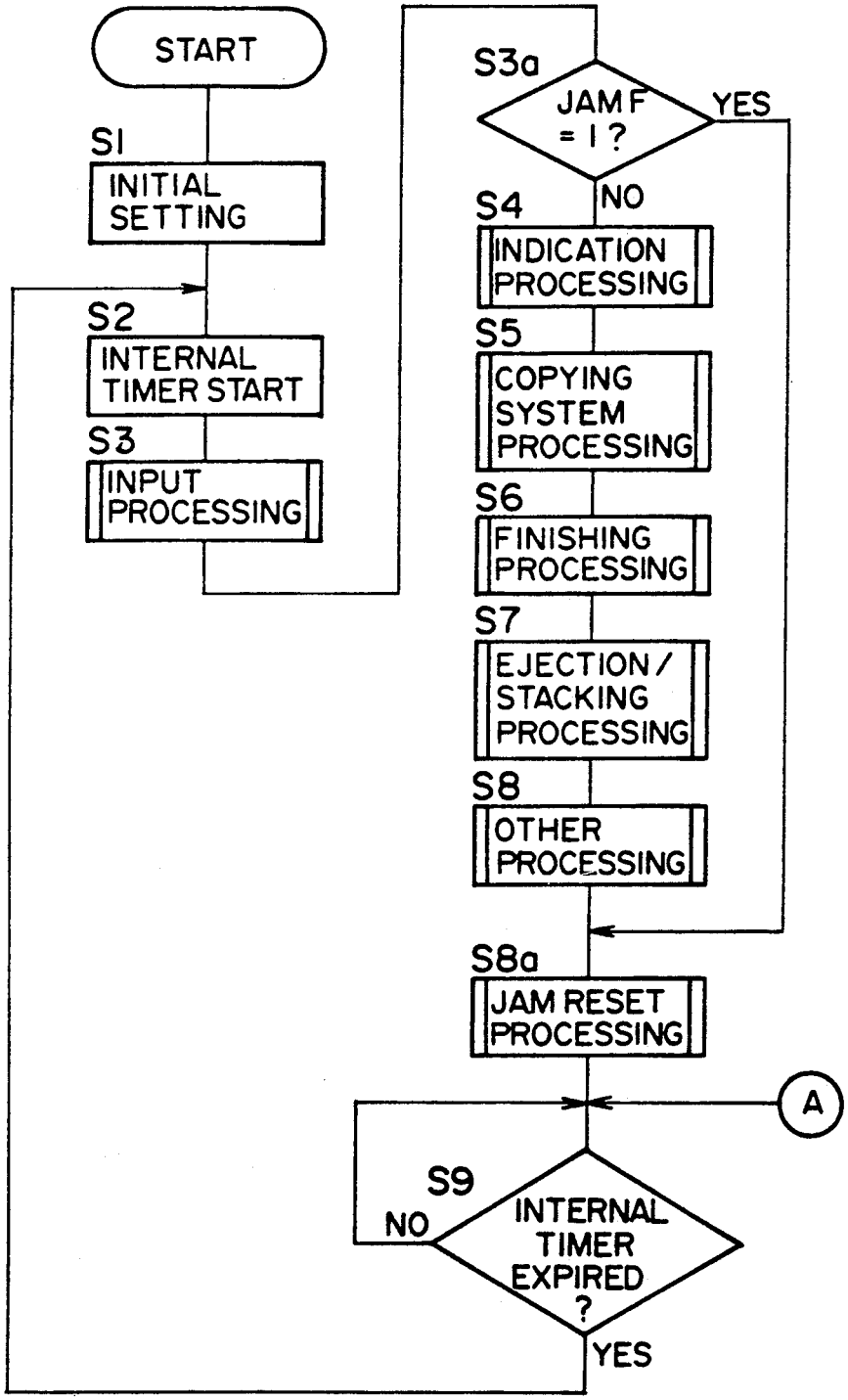
Figure 12A:
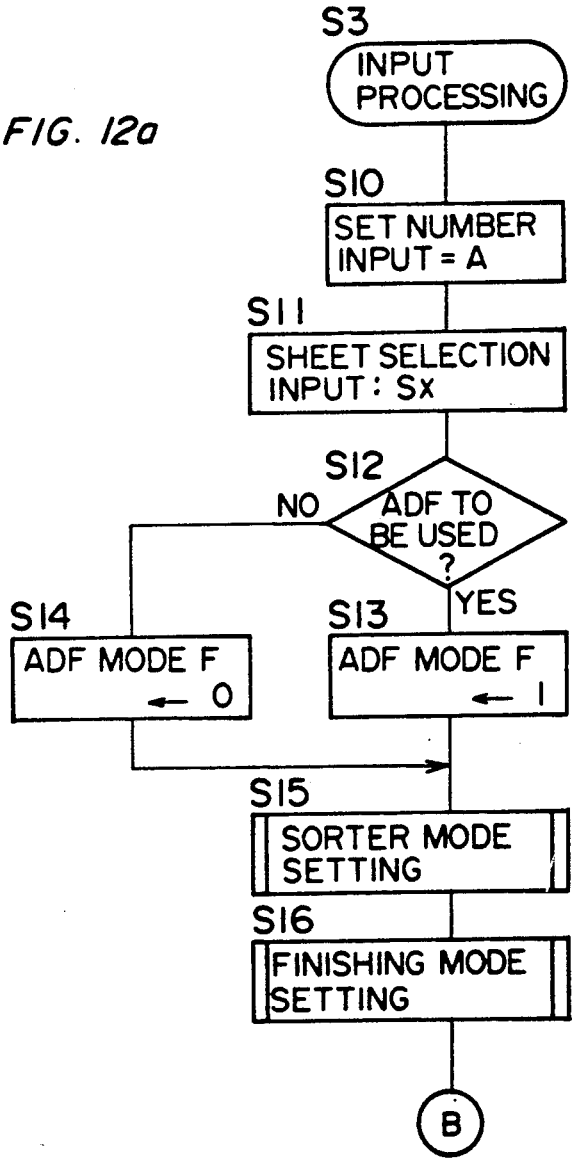
Figure 13:
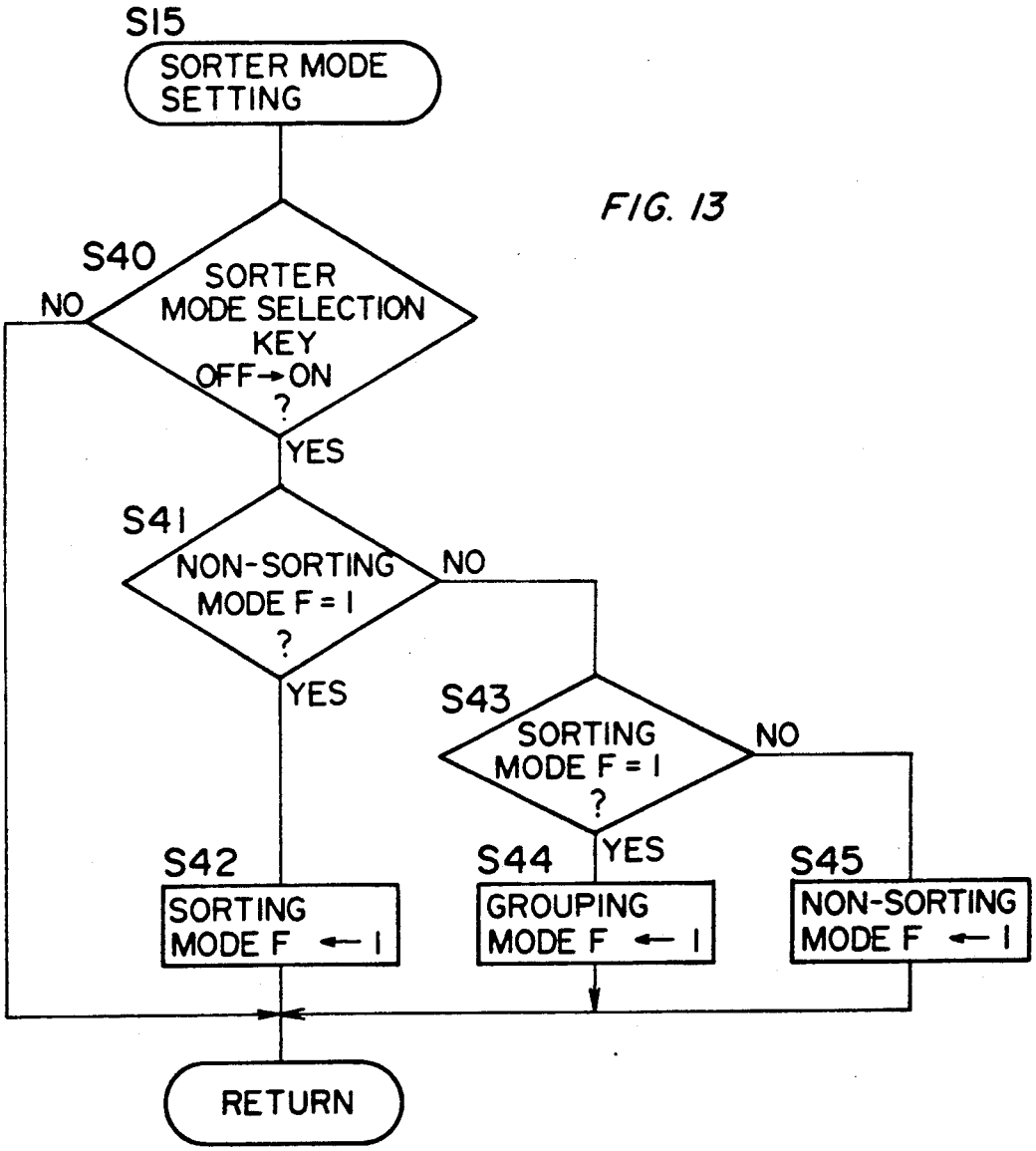
Figure 14:
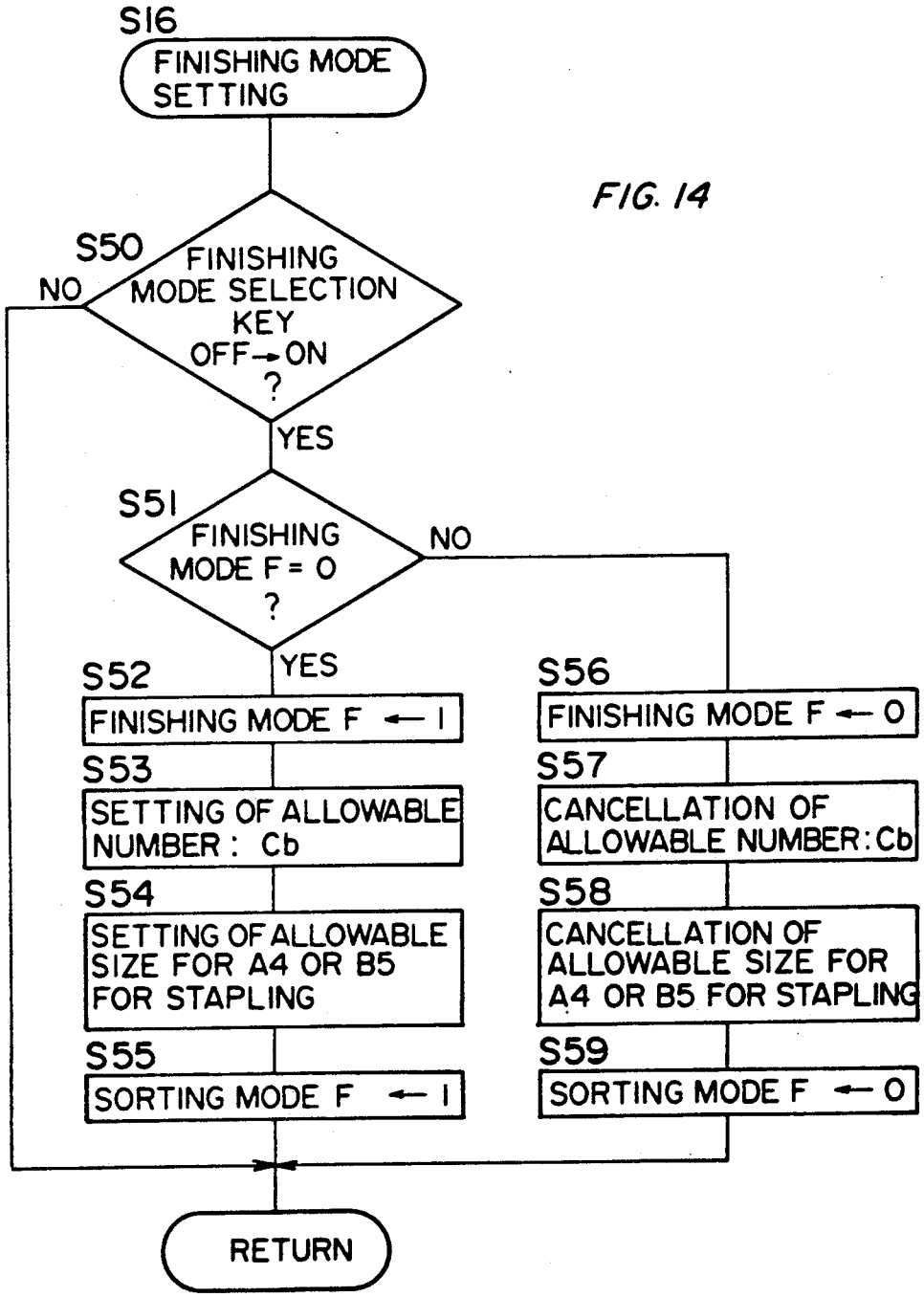
Figure 15A:
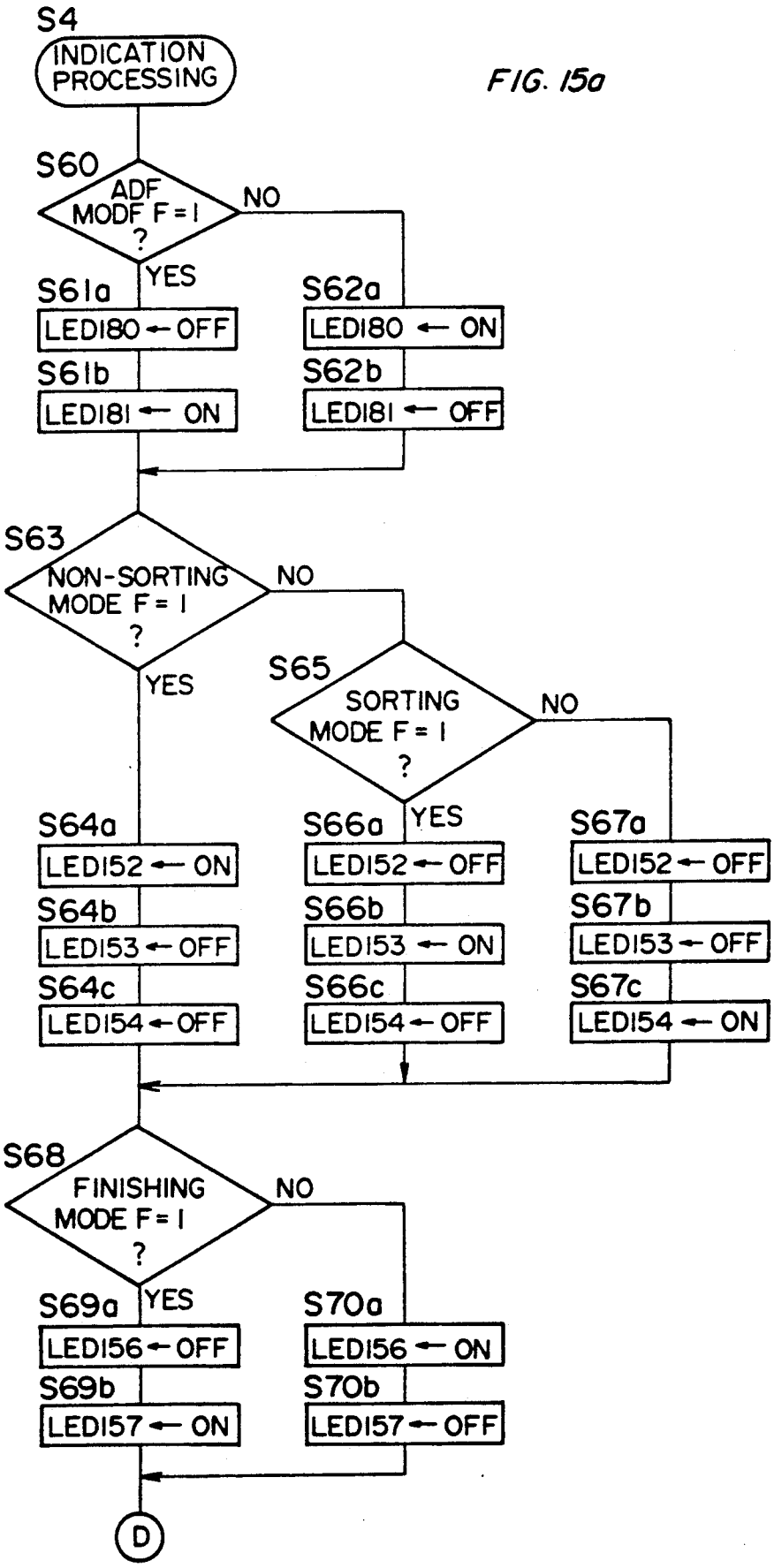
Figure 15B:
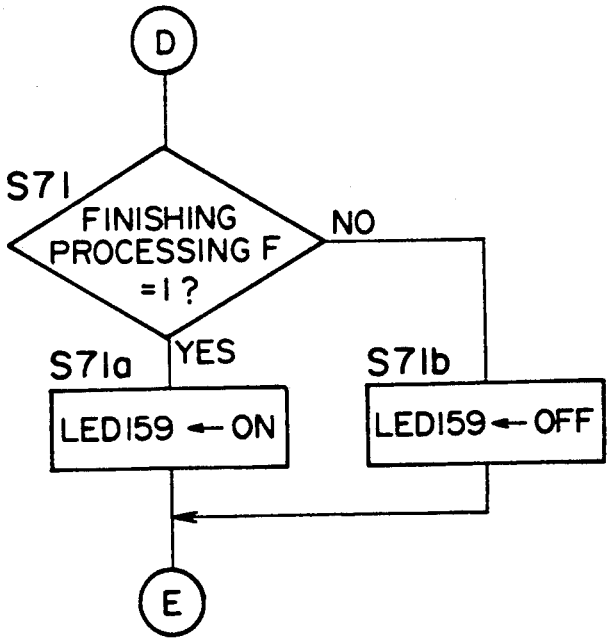
Figure 15D:
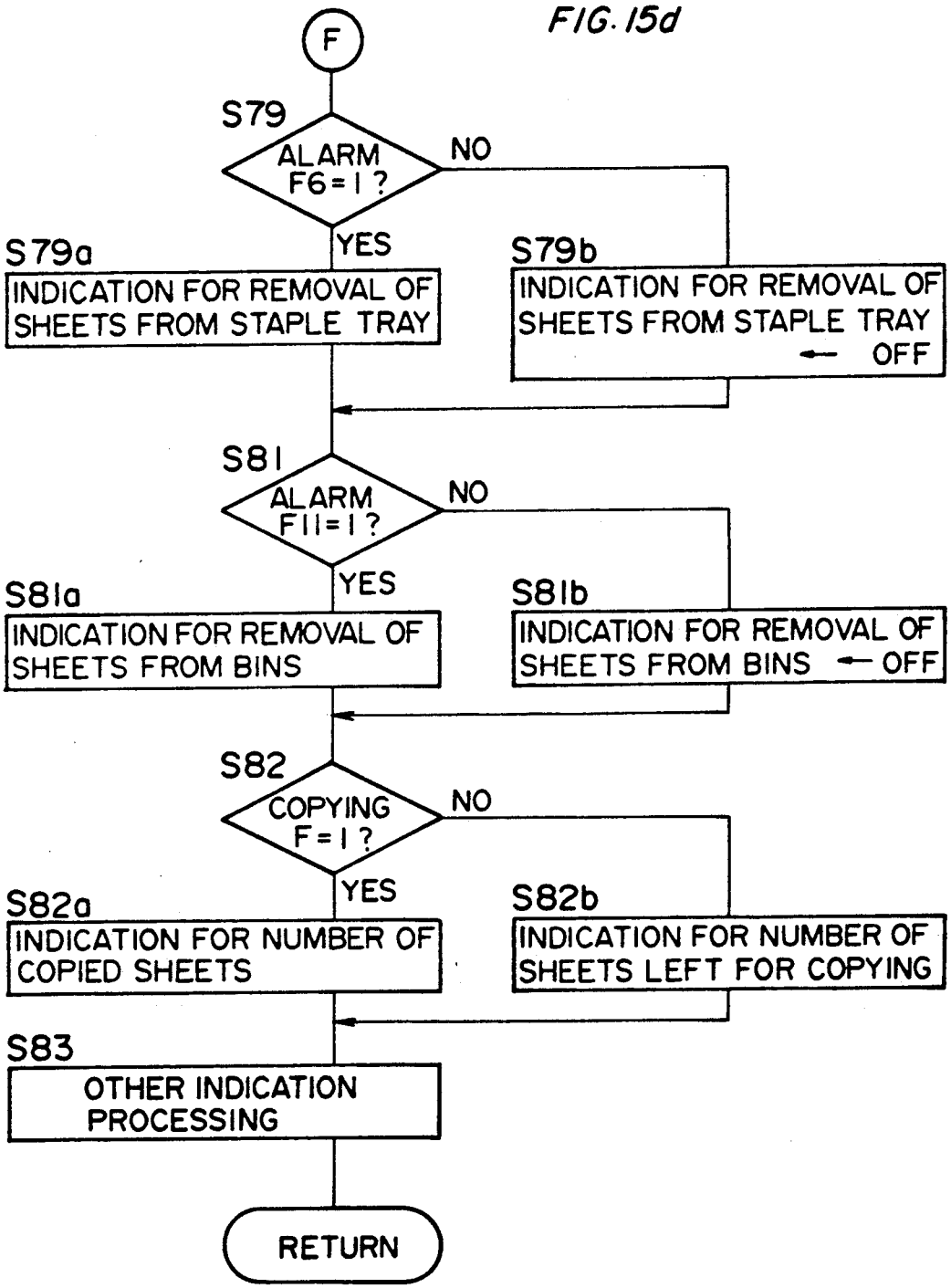
Figure 16:
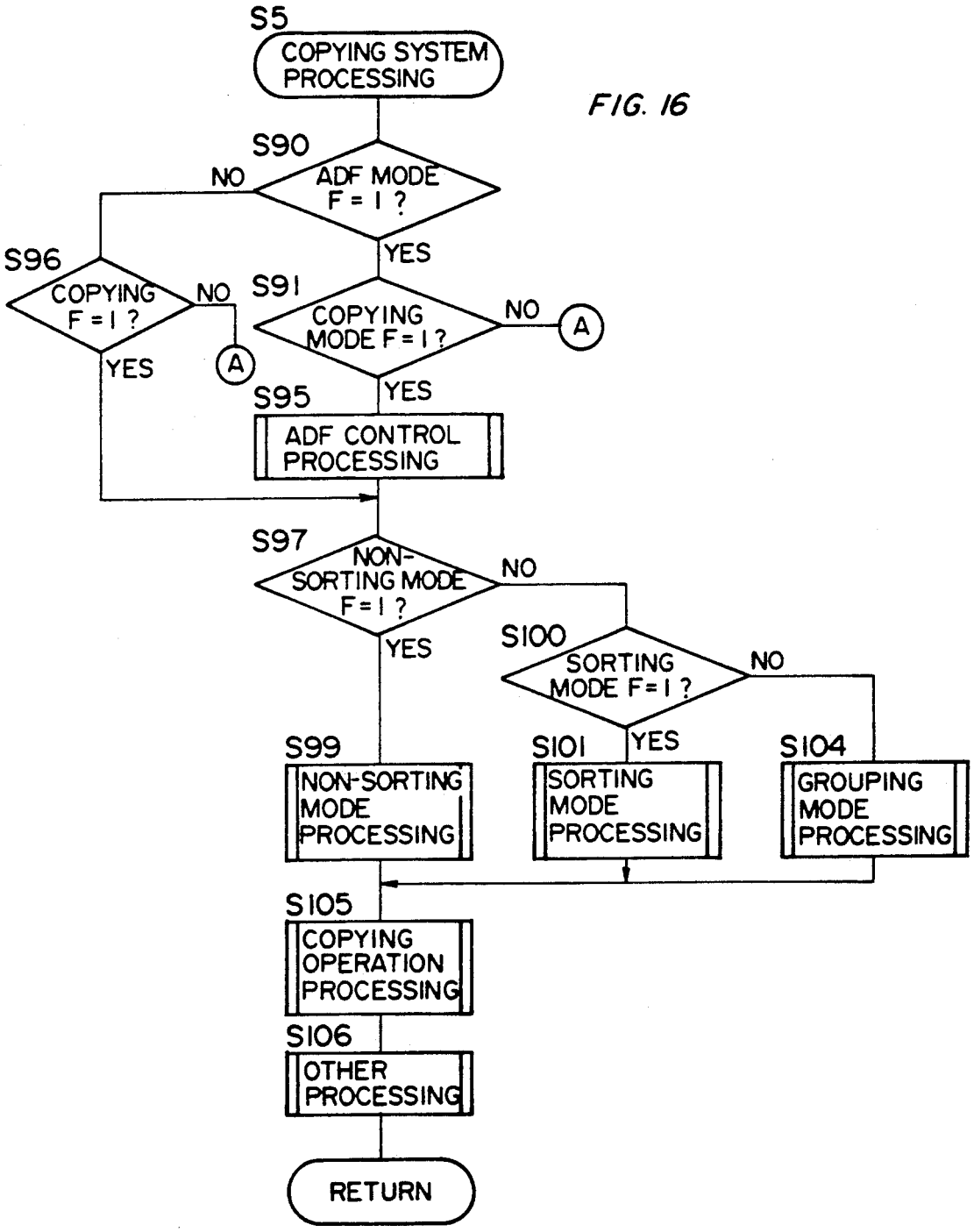
Figure 17:
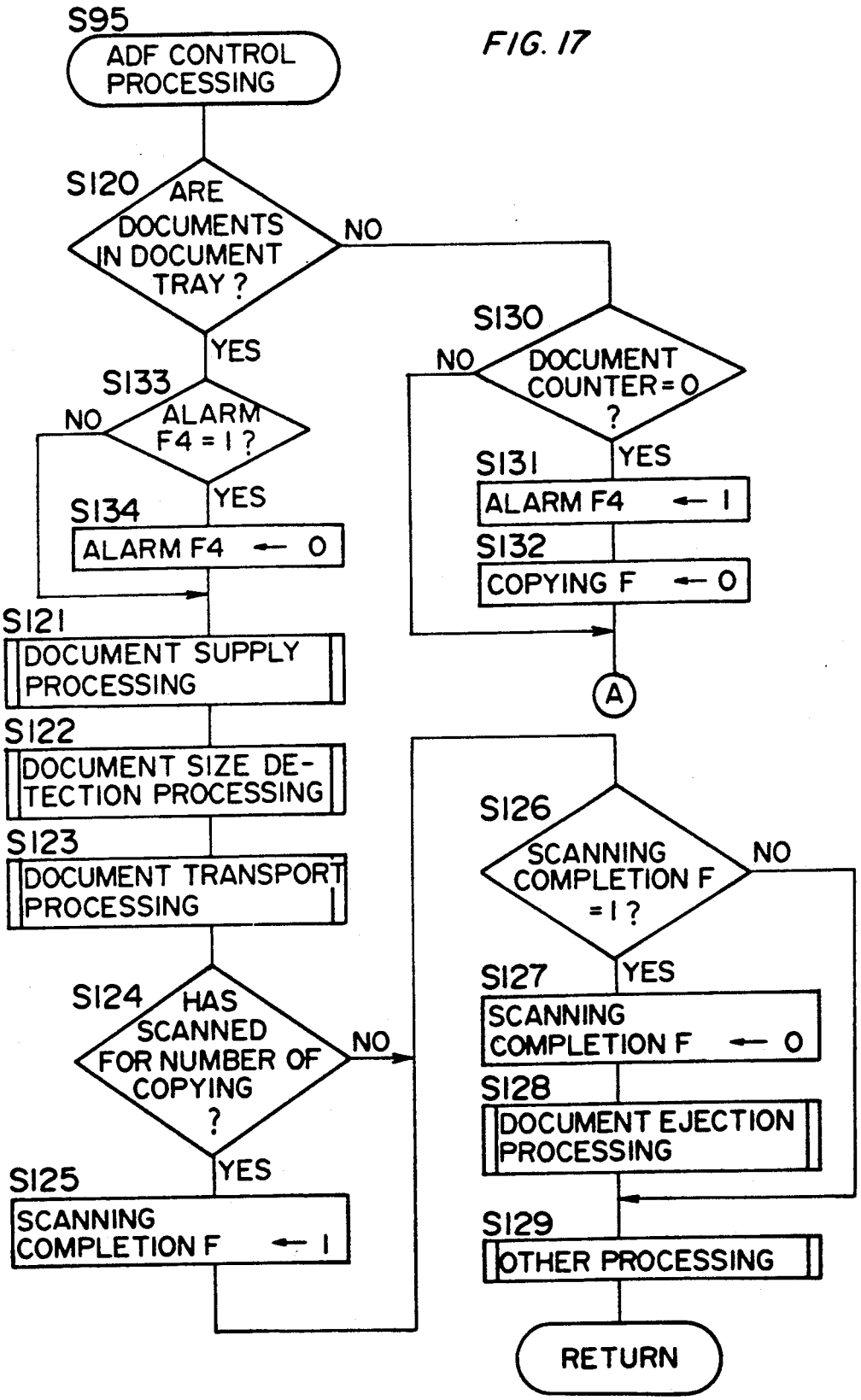
Figure 18A:
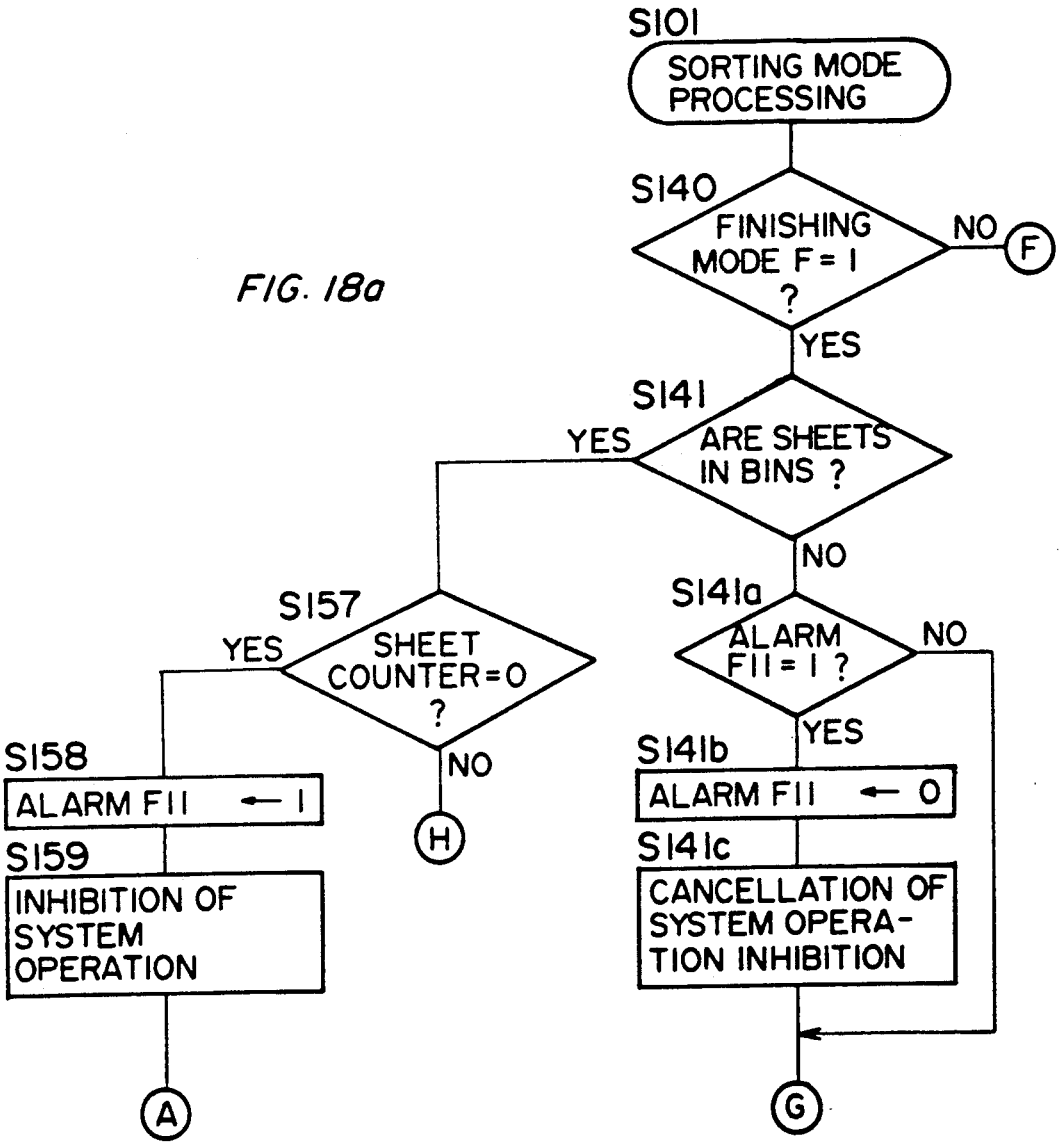
Figure 18B:
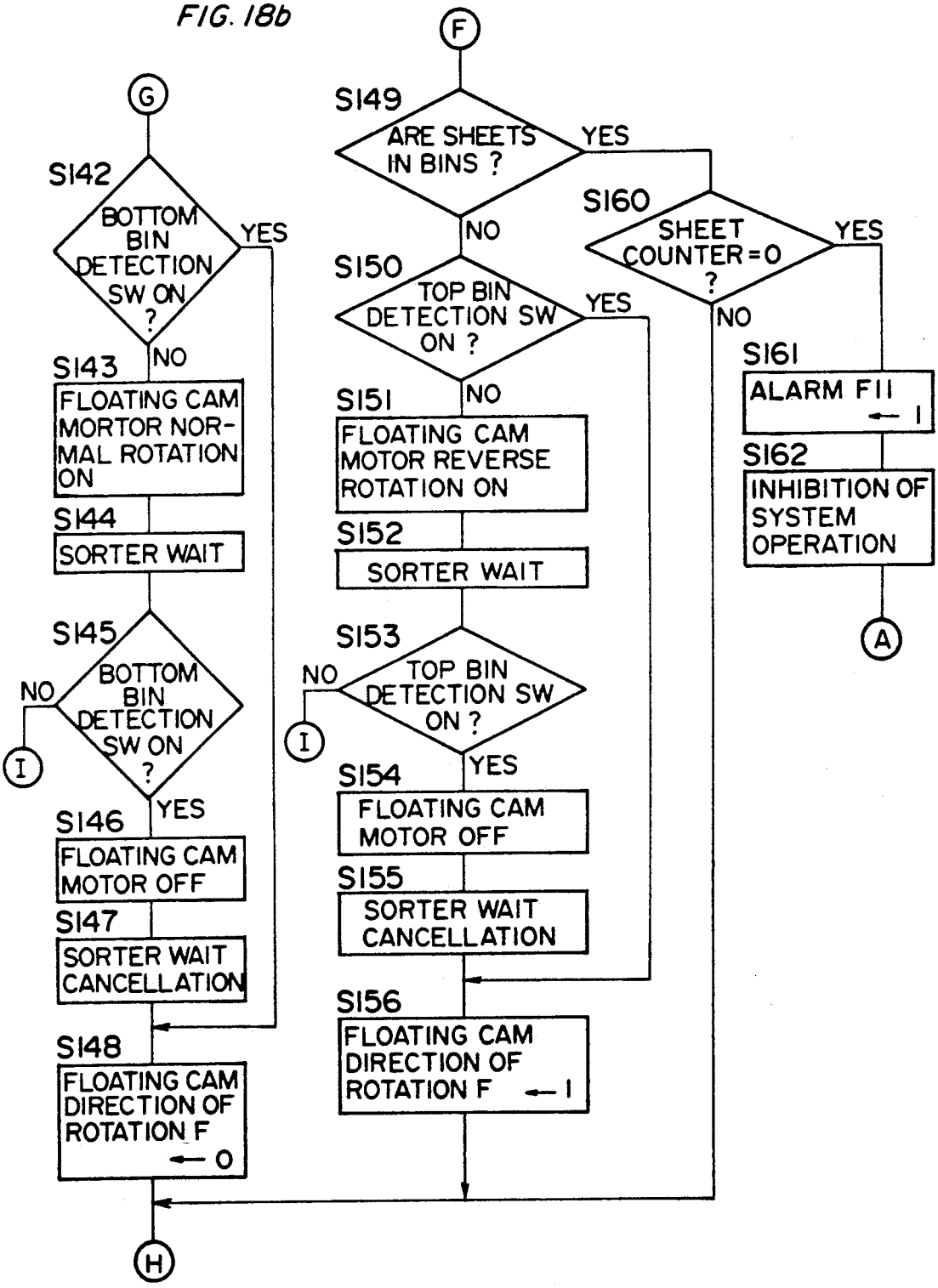
Figure 18C:
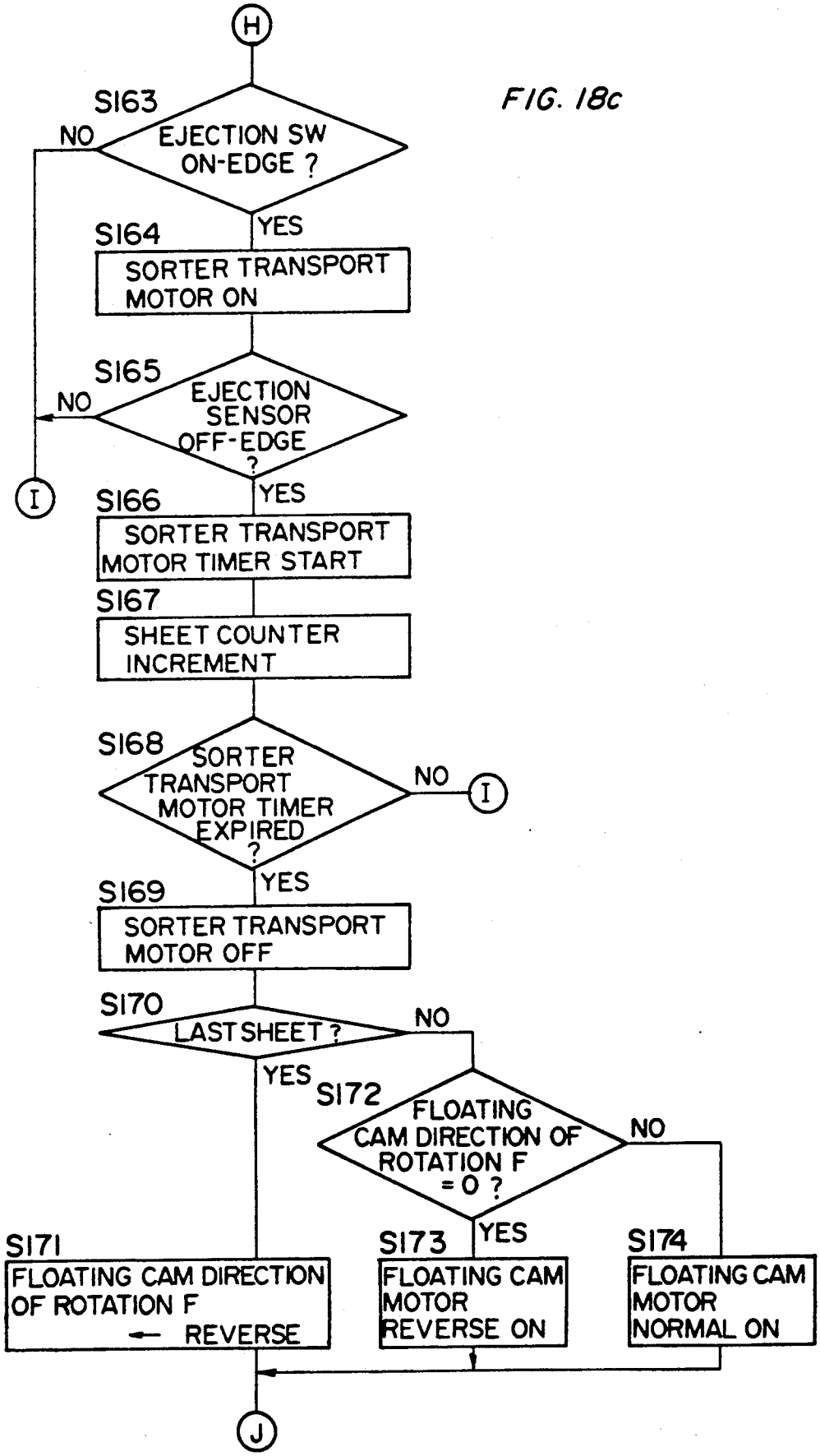
Figure 18D:
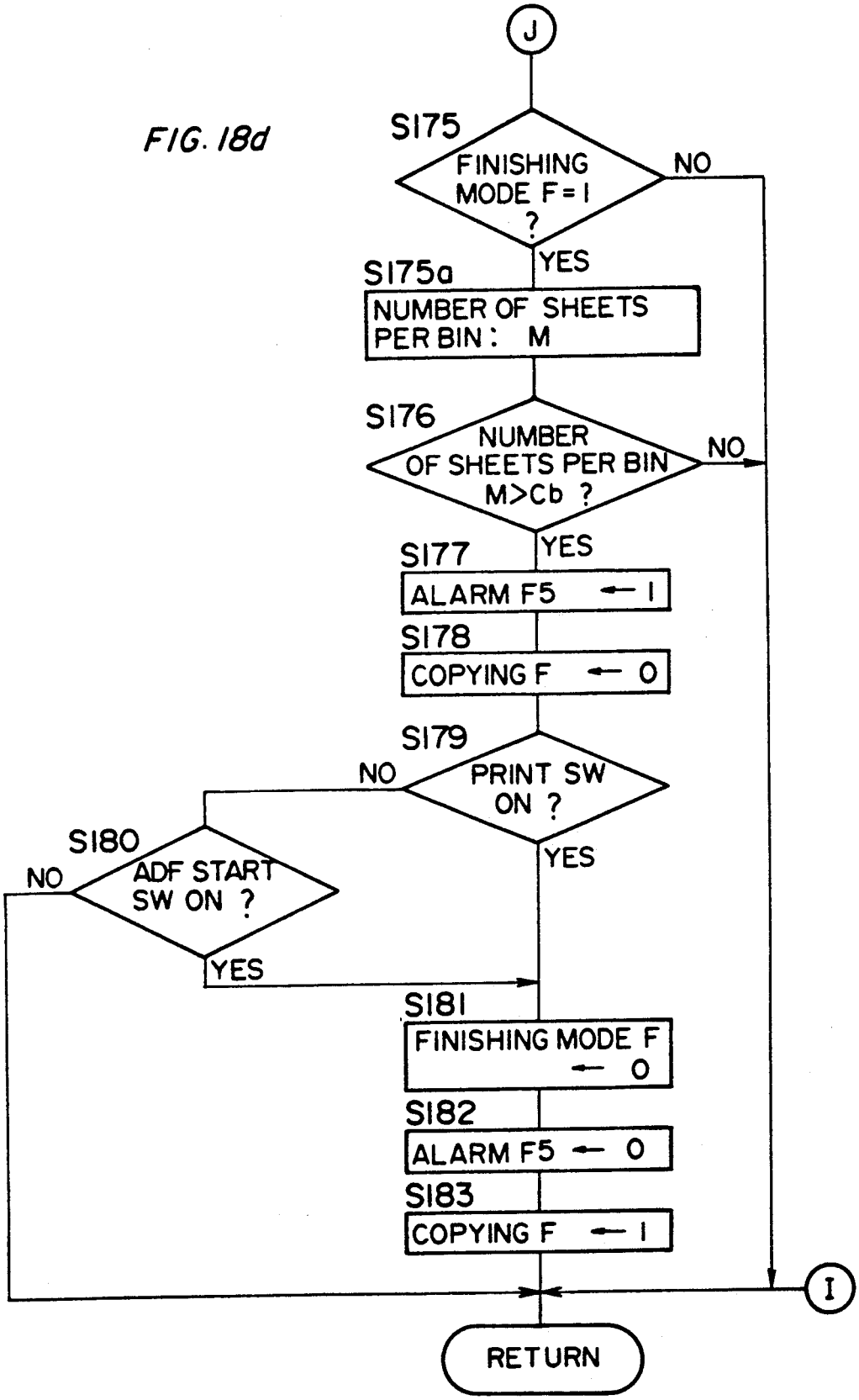
Figure 19:
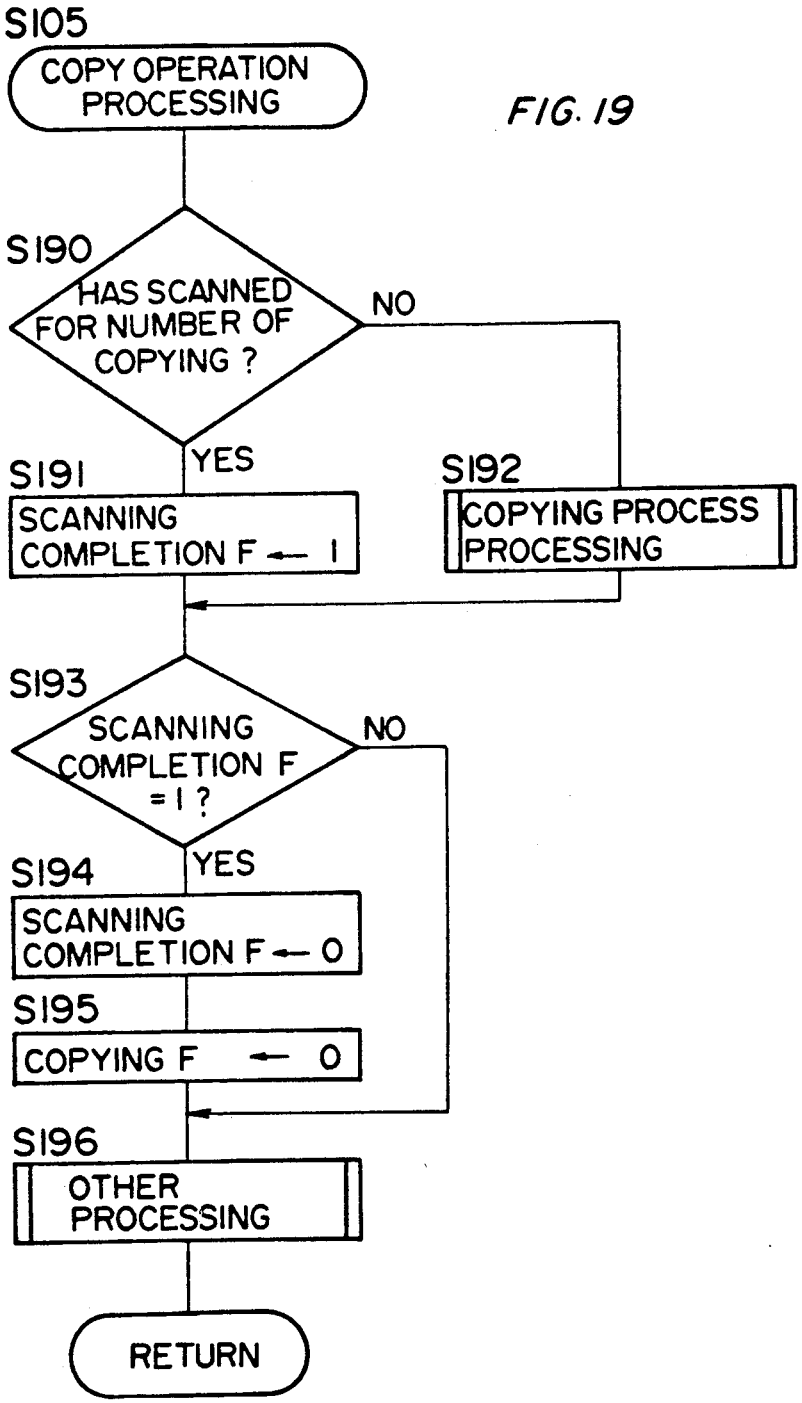
Figure 20A:
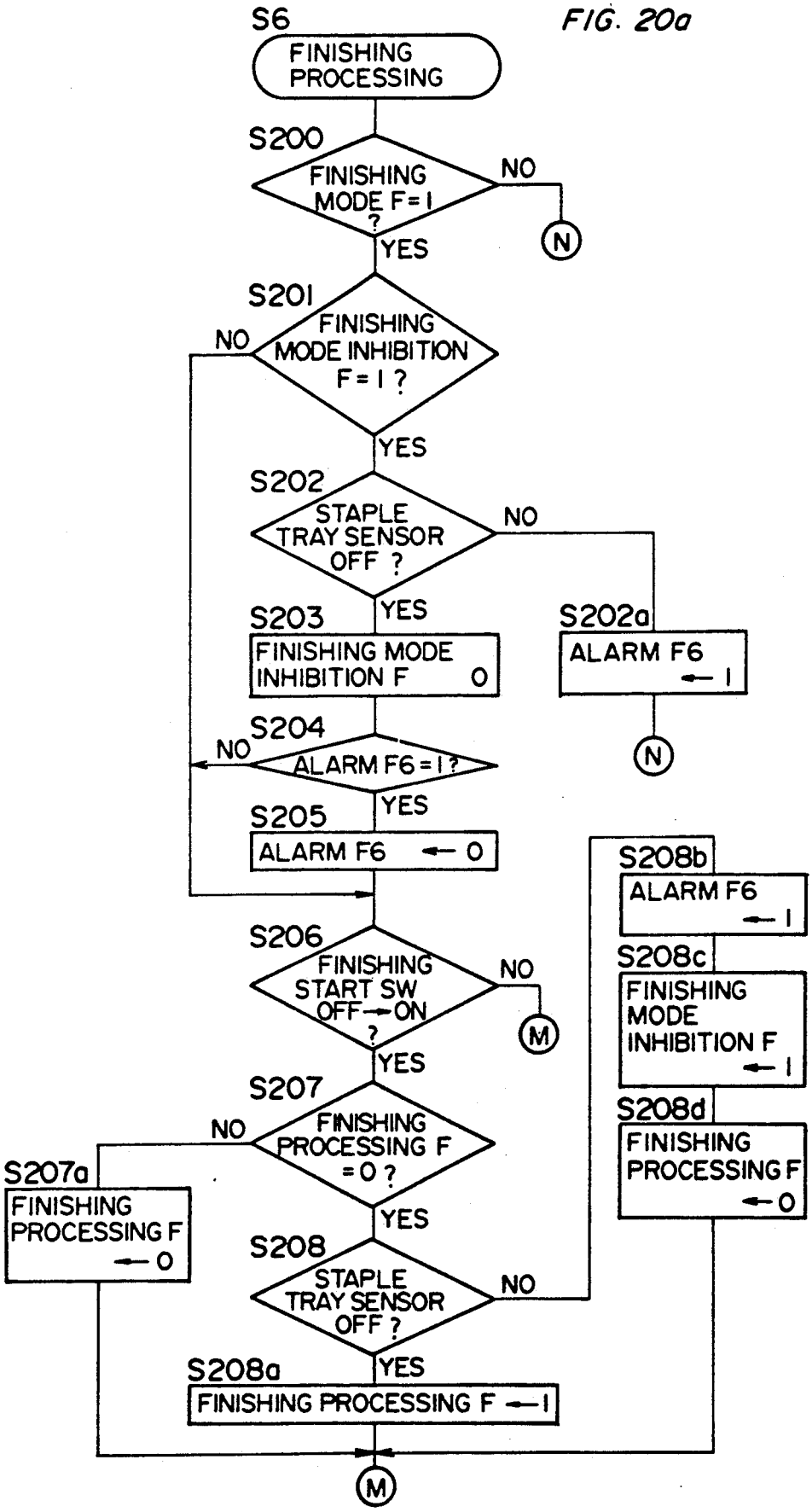
Figure 20B:
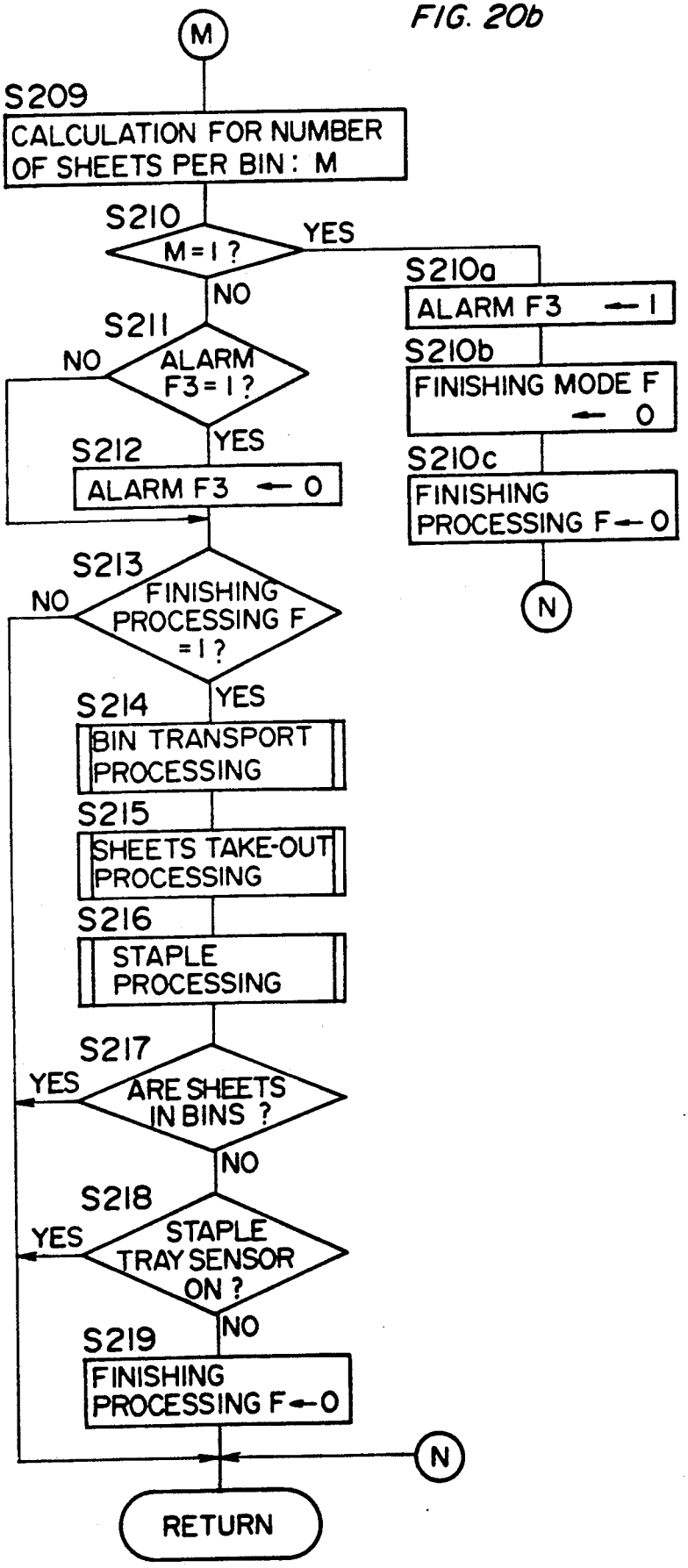
Figure 21:
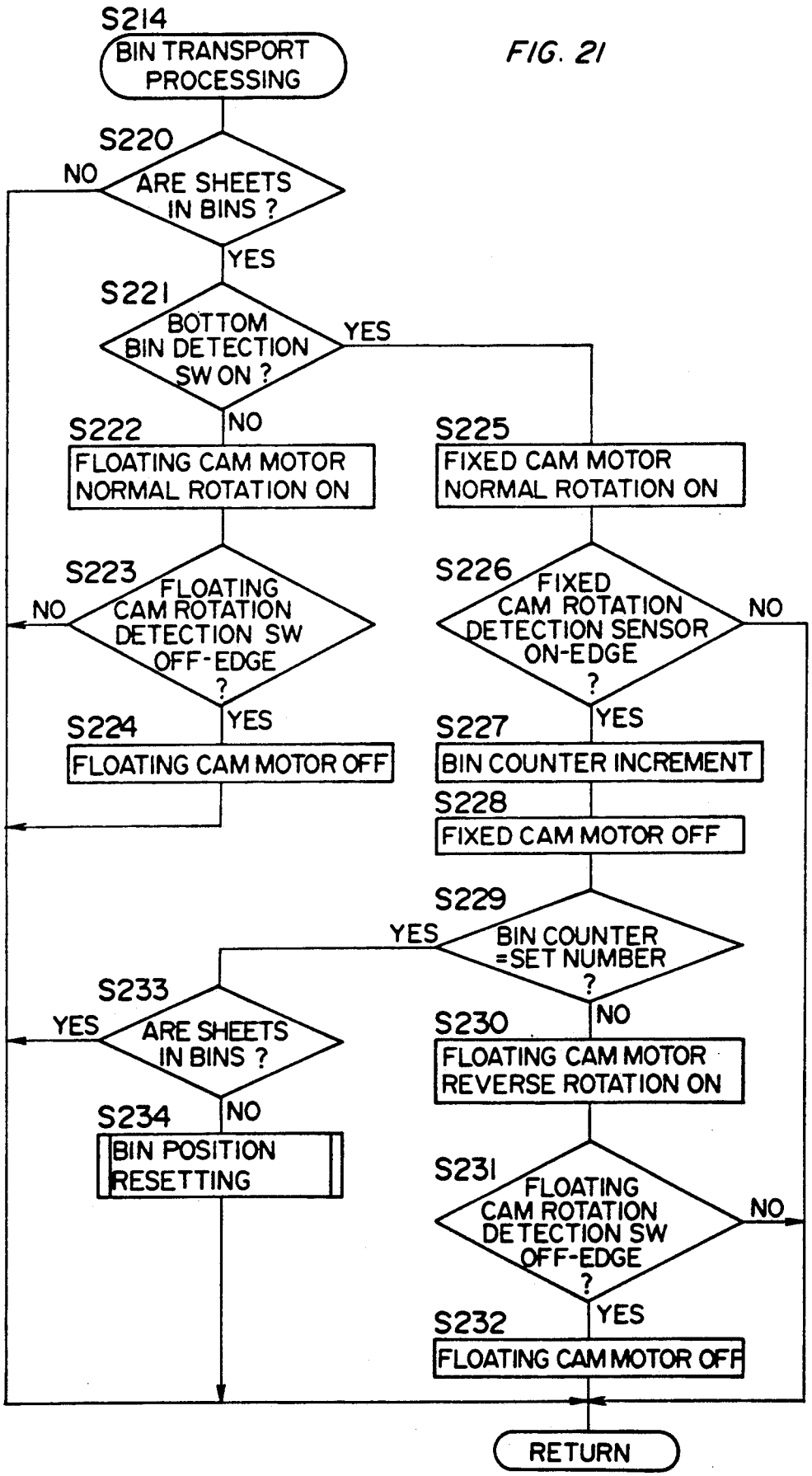
Figure 22:
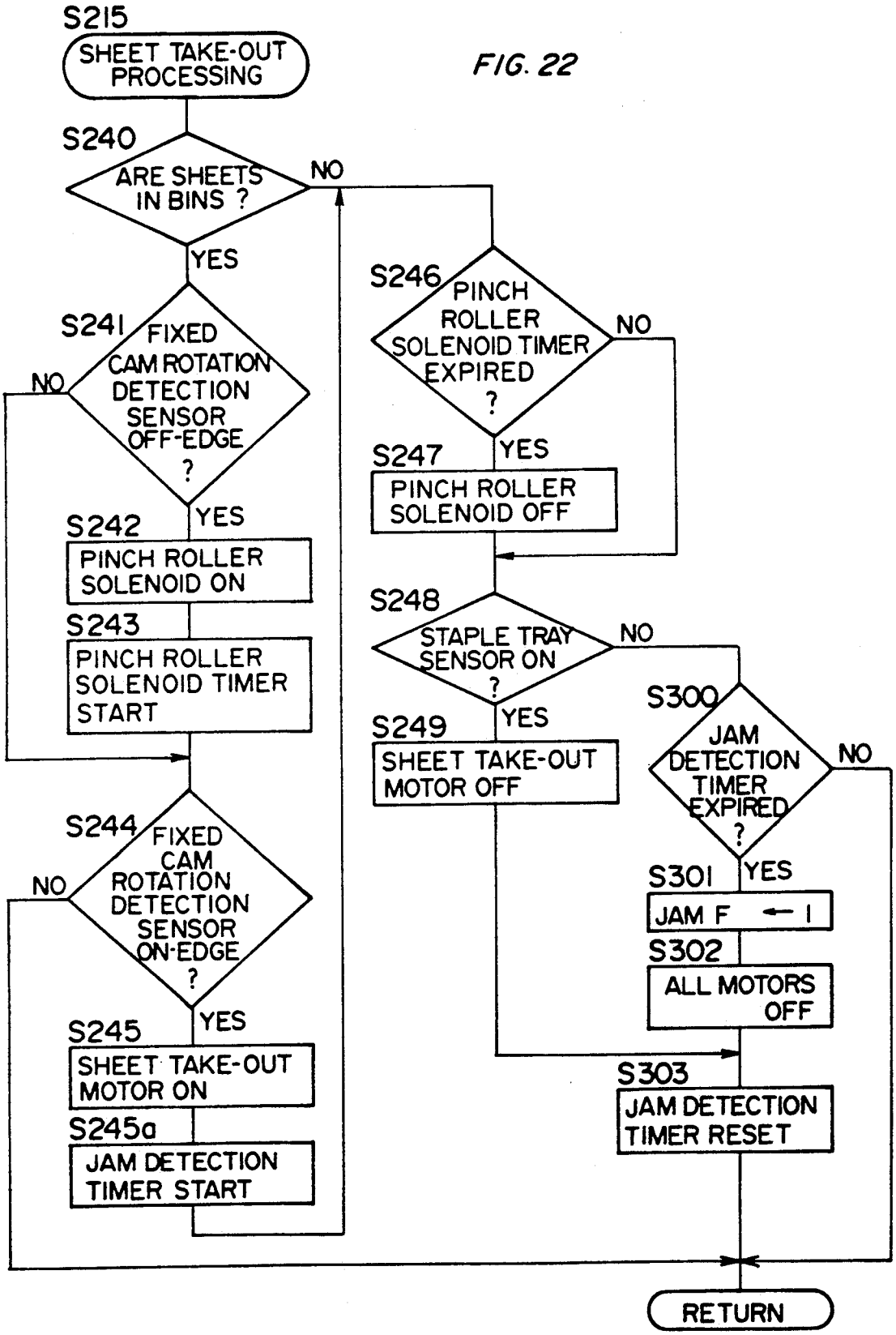
Figure 23:
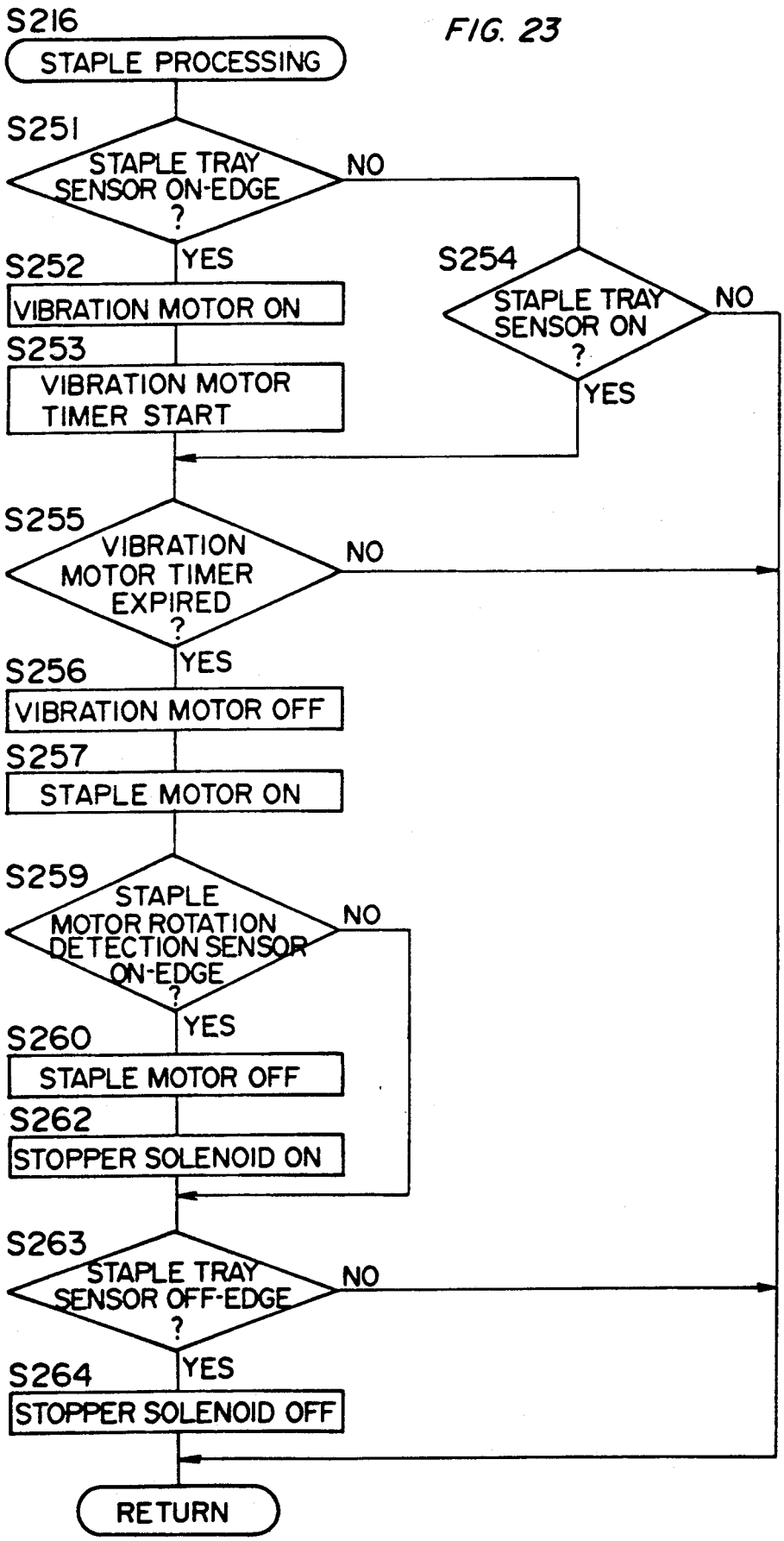

FIG .5 is a perspective view of a sheet take-out position;

FIG. 6 is a plan view of an operation panel of the copying machine;

FIG. 7 is a plan view of an operation panel of an automatic document feeder;

FIG. 8 is a plan view of an operation panel of the sorter-finisher;

FIG. 9 is a block diagram of a control circuit;

FIG. 10 is a detail block diagram of the control circuit;

FIG. 11 is a flowchart showing a main routine of a CPU;

FIGS. 12*a* and 12*b* are flowcharts showing a subroutine for the input processing;

FIG. 13 is a flowchart showing a subroutine for the sorter mode setting;

FIG. 14 is a flowchart showing a subroutine for the finishing mode setting;

FIGS. 15*a*, 15*b*, 15*c* and 15*d* are flowcharts showing a subroutine for the indication processing;

FIG. 16 is a flowchart showing a subroutine for the copying system processing;

FIG. 17 is a flowchart showing a subroutine for the ADF control processing;

FIGS. 18*a*, 18*b*, 18*c* and 18*d* are flowcharts showing a subroutine for the sorting mode processing;

FIG. 19 is a flowchart showing a subroutine for the copying operation processing;

FIGS. 20*a* and 20*b* are flowcharts showing a subroutine for the finishing processing;

FIG. 21 is a flowchart showing a subroutine for the bin transport processing;

FIG. 22 is a flowchart showing a subroutine for the sheet take-out processing; and FIG. 23 is a flowchart showing a subroutine for the staple processing.

Figure 24:
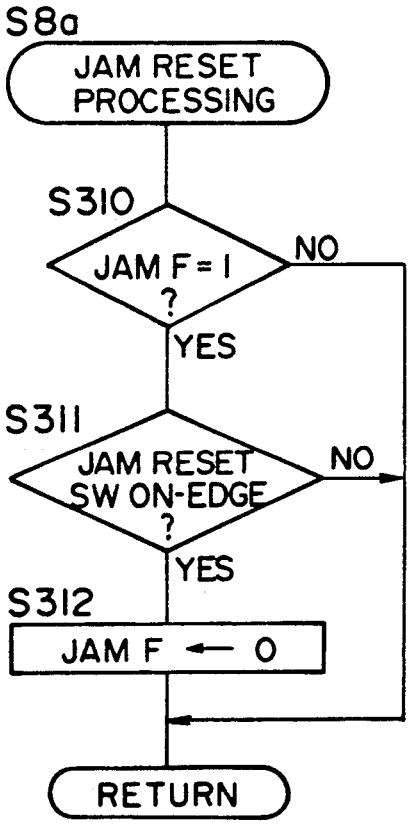

FIG. 24 is a flowchart showing a subroutine for the jam reset processing.

Figure 25:
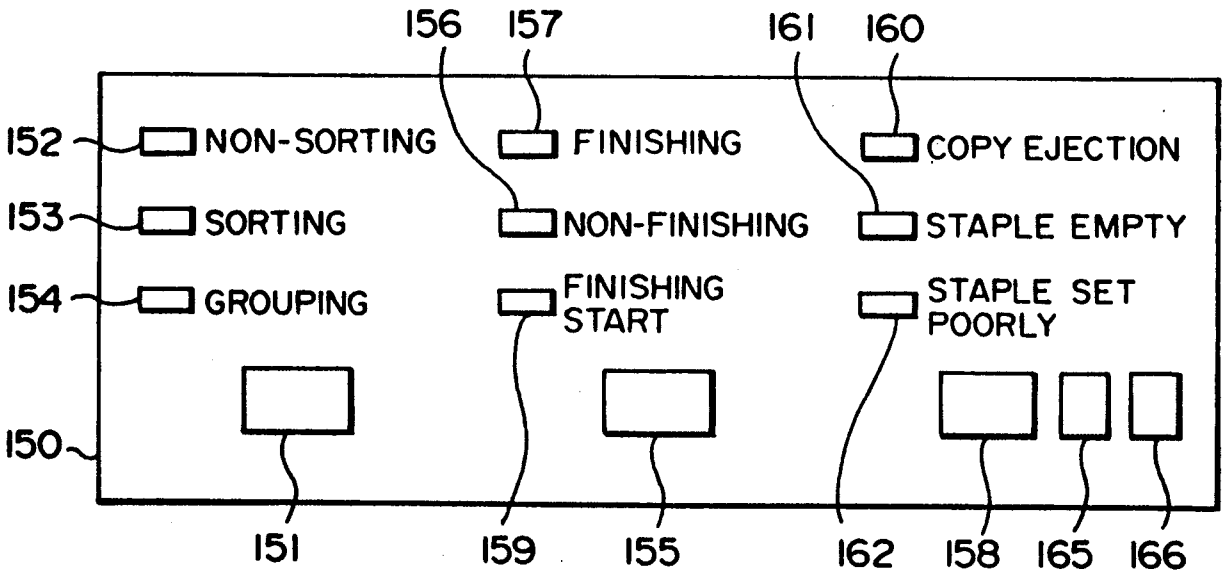
Figure 26:
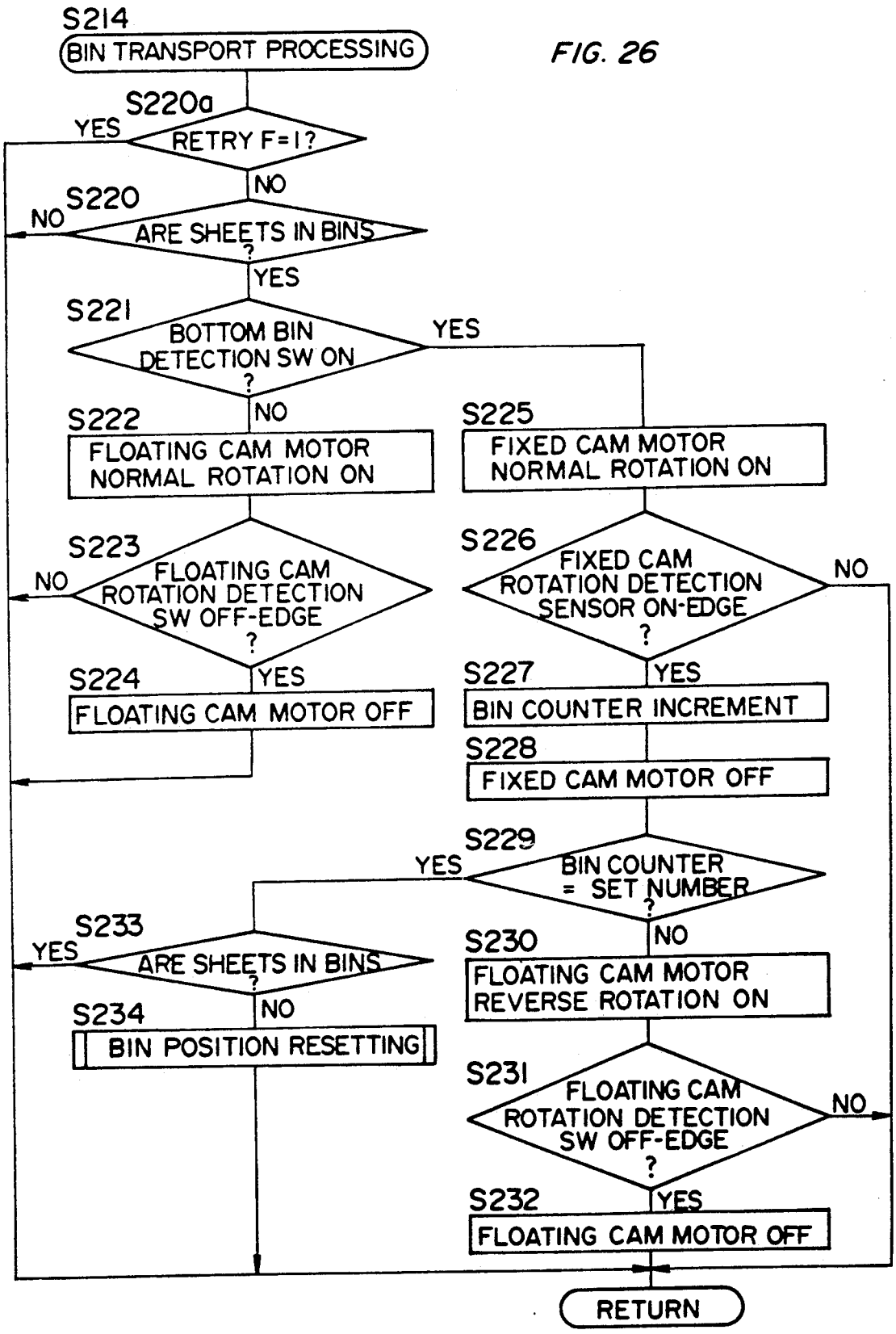
Figure 27A:
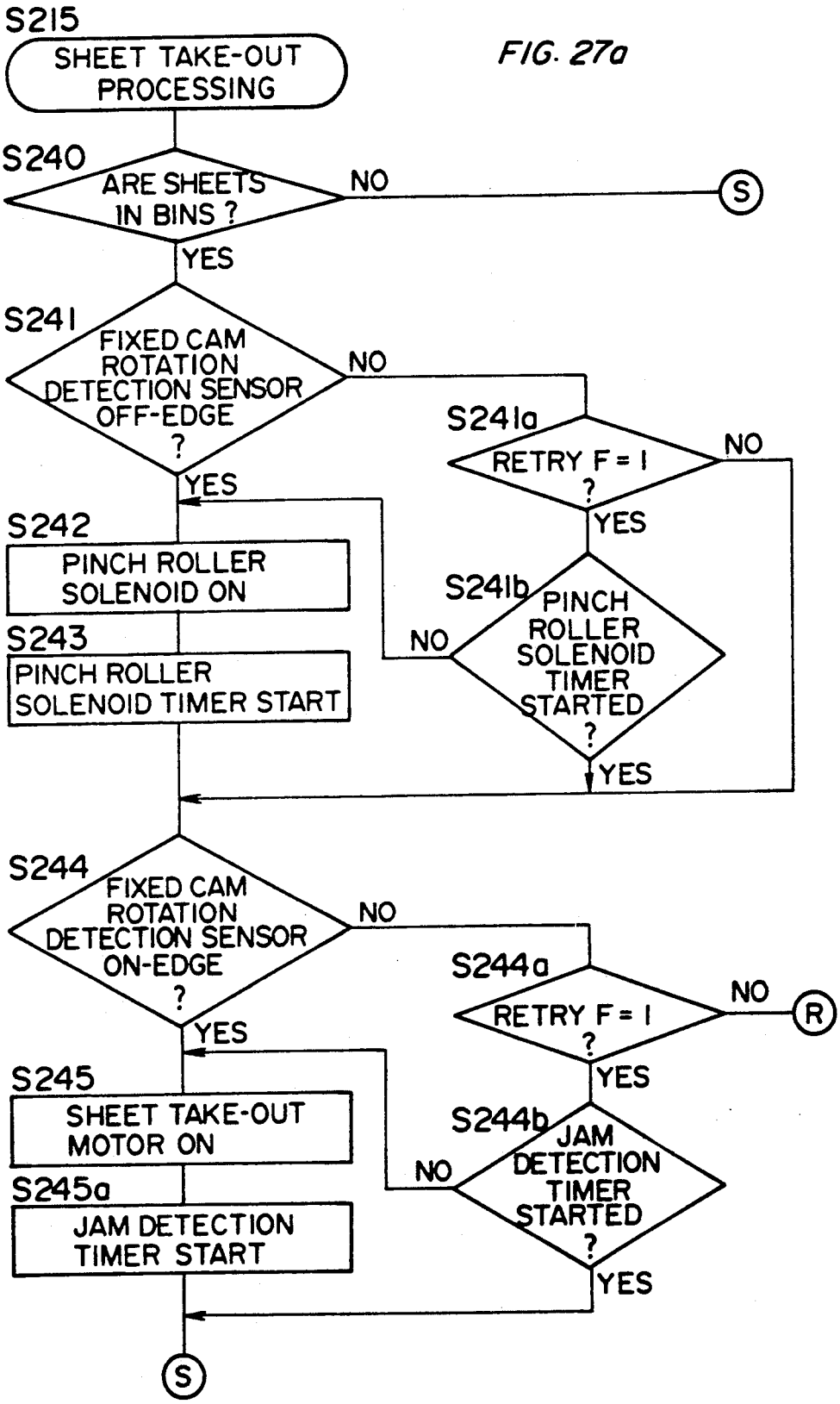
Figure 27B:
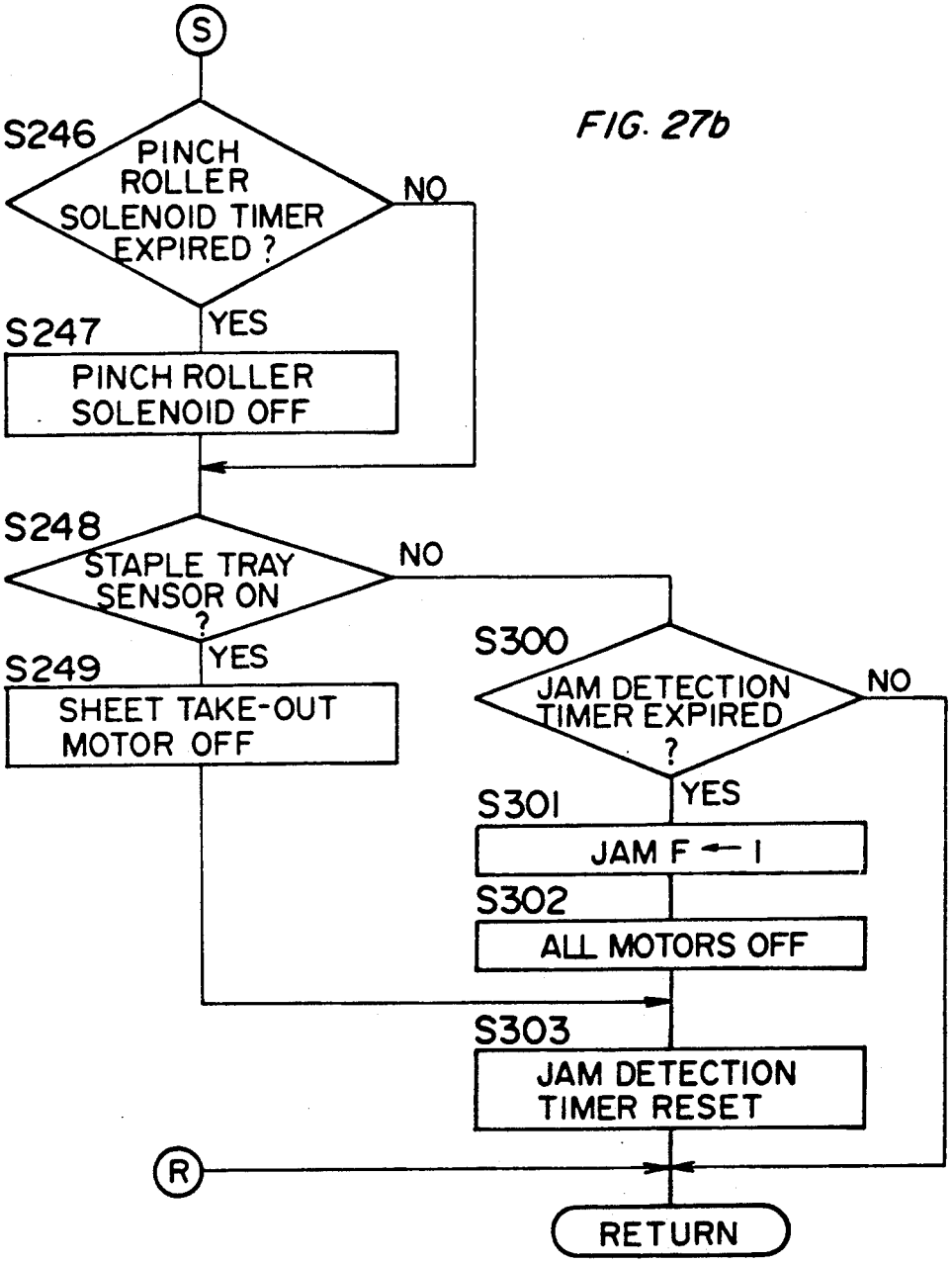
Figure 28:
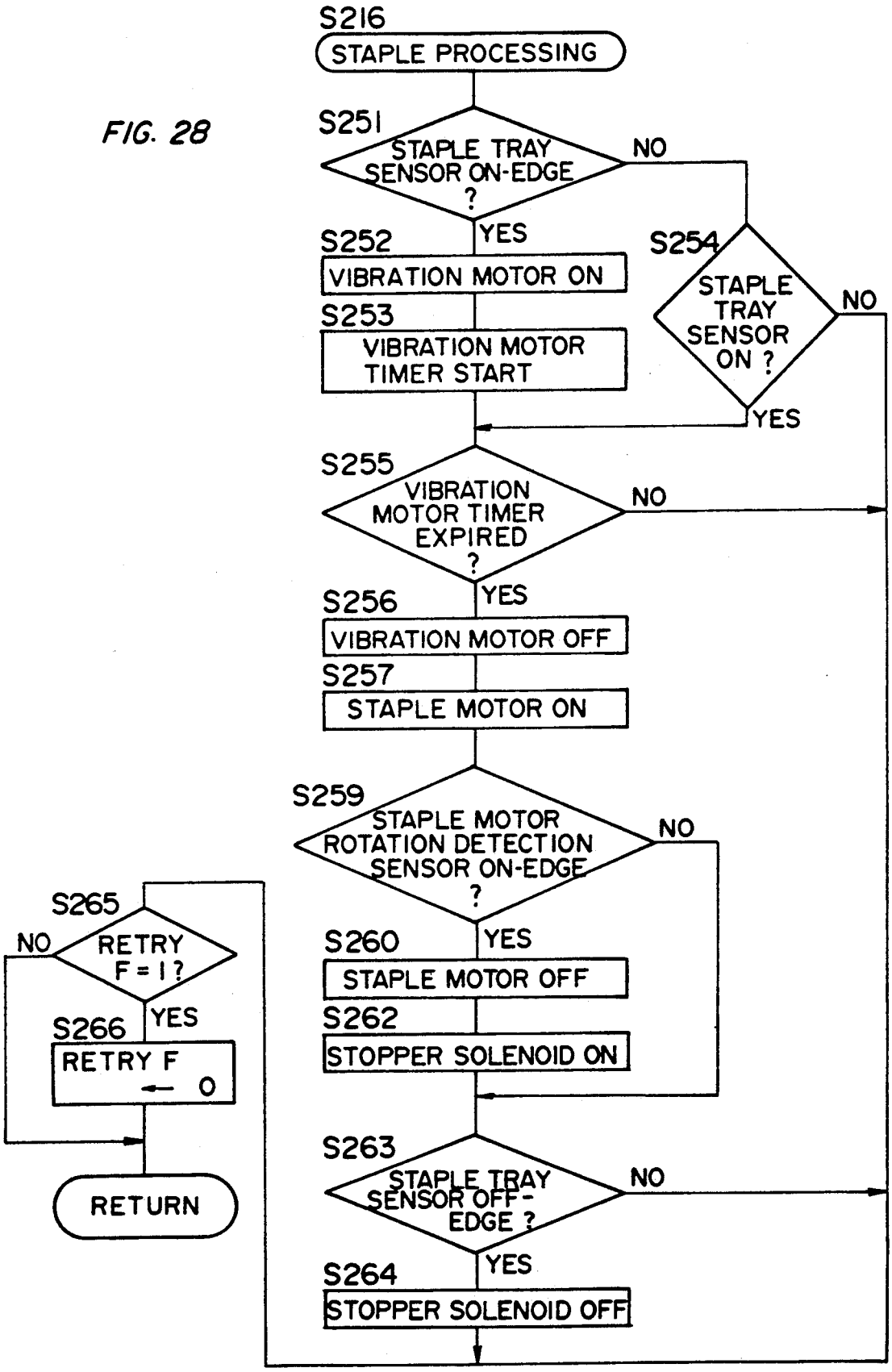
Figure 29:
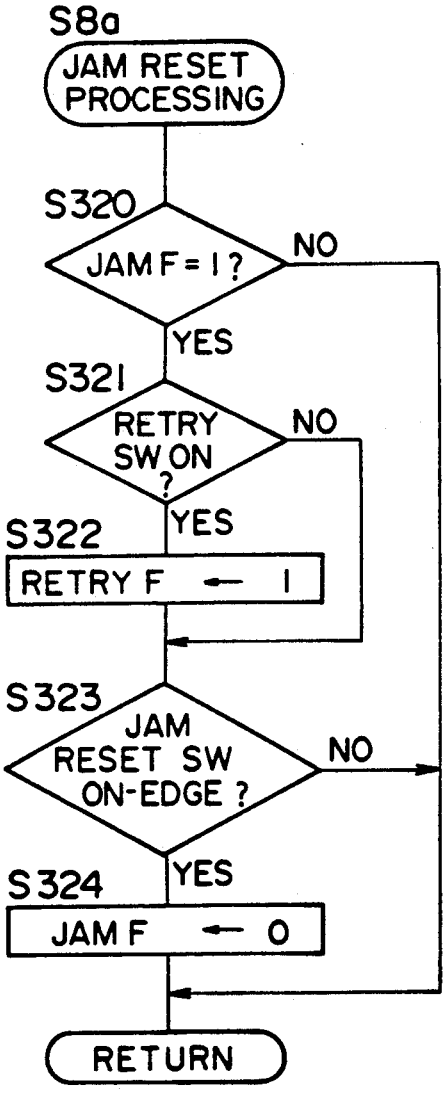
Figure 30:
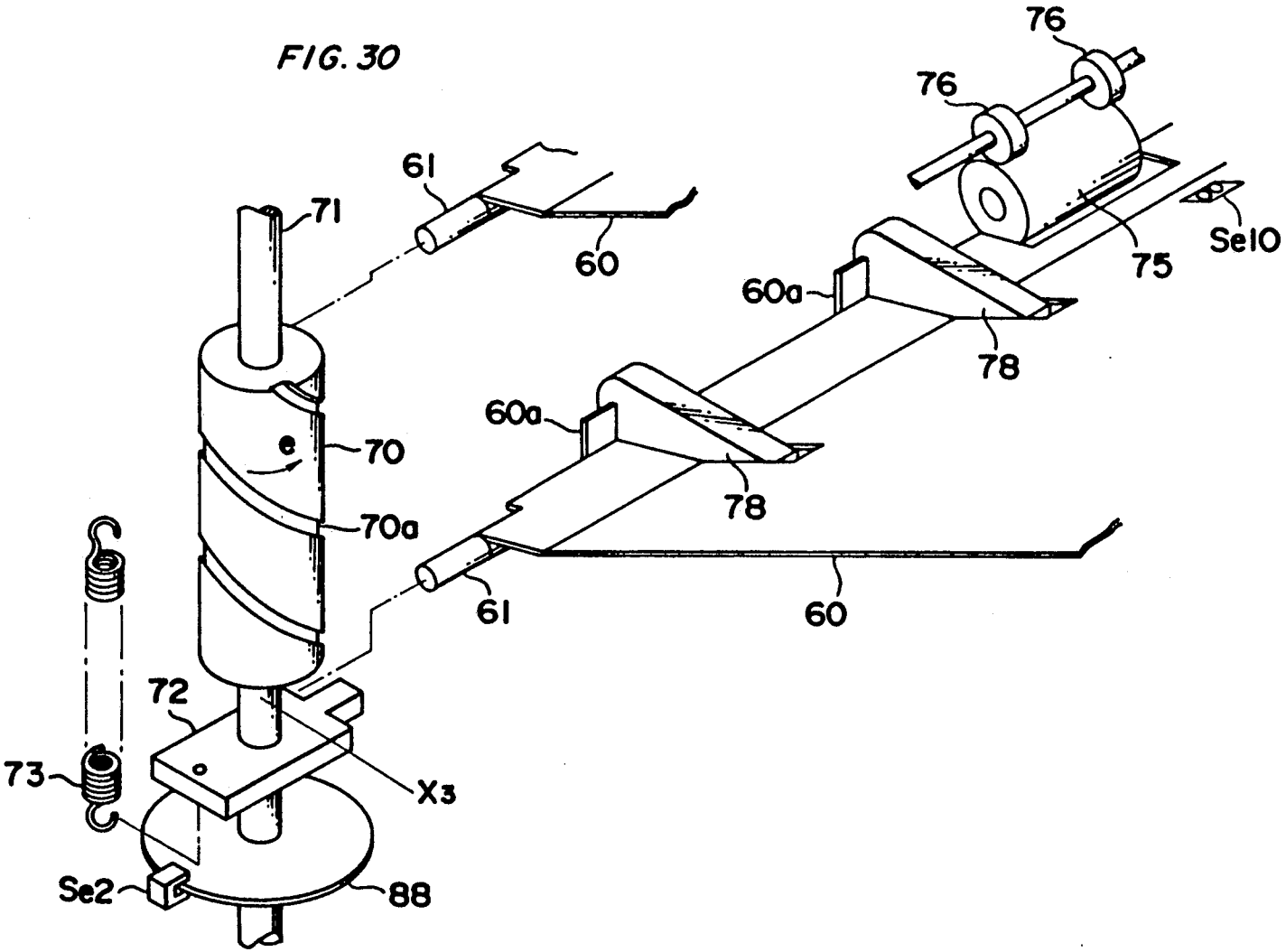
Figure 31:
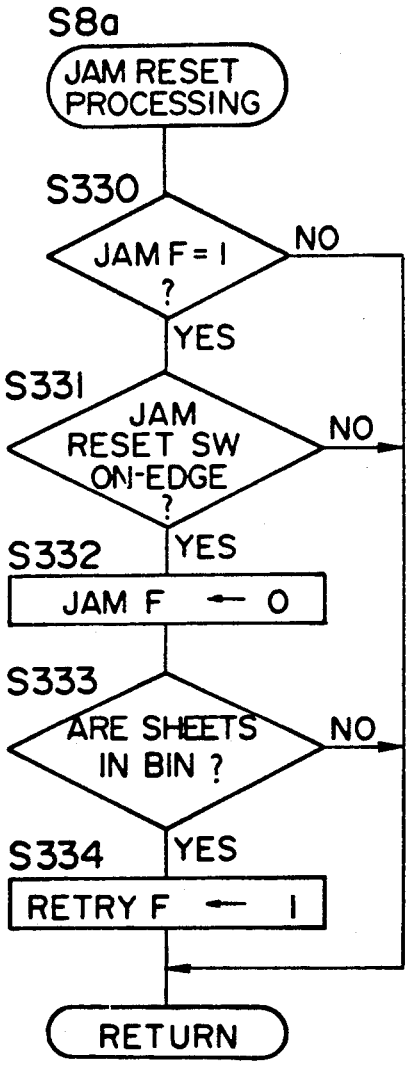
Figure 32:
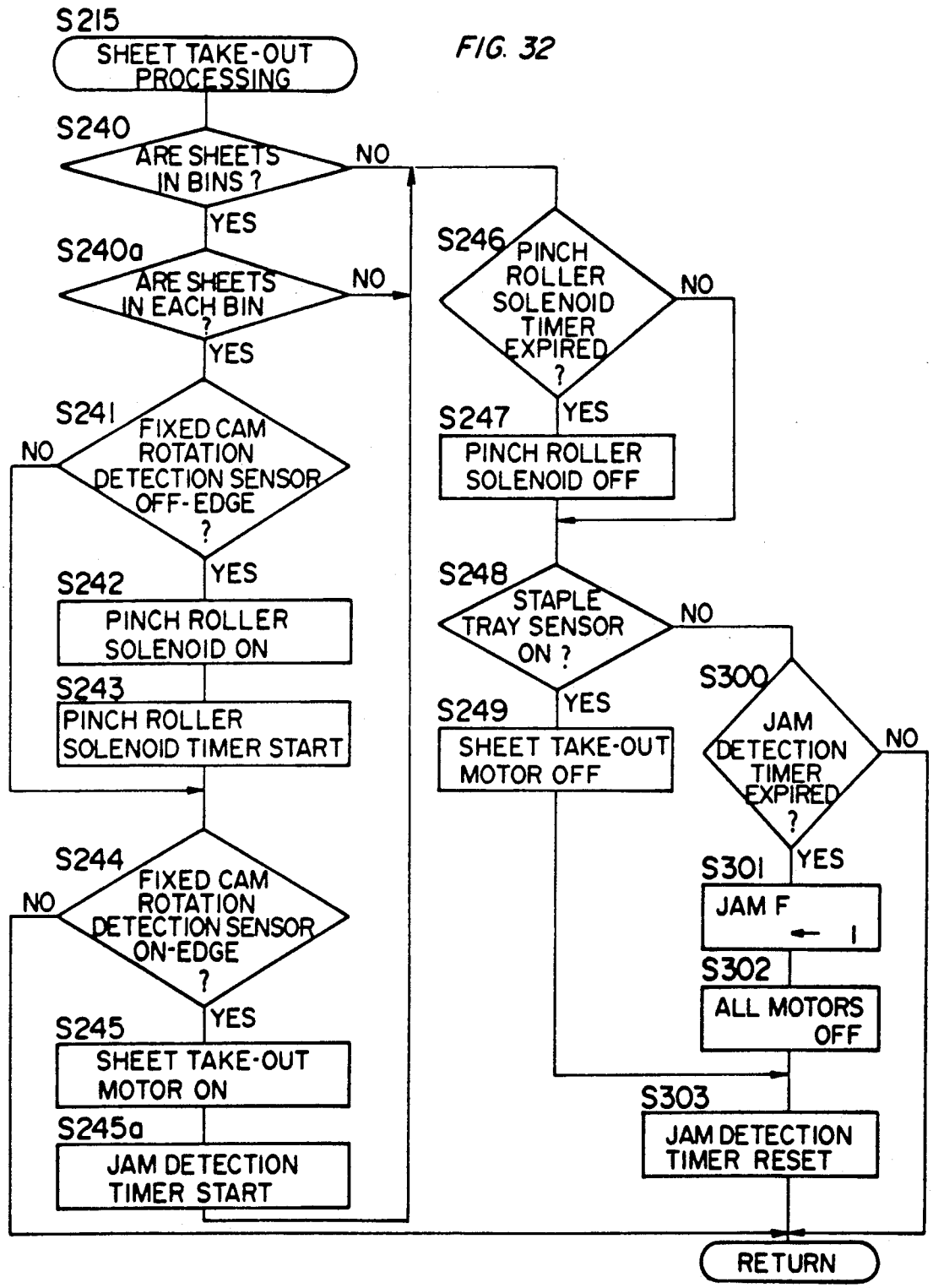

FIGS. 25 through 29 show a second embodiment according to the present invention;

FIG. 25 is a plan view of an operation panel of the sorter-finisher;

FIG. 26 is a flowchart showing a subroutine for the bin transport processing;

FIG. 27*a* and 27*b* are flowcharts showing a subroutine for the sheet take-out processing;

FIG. 28 is a flowchart showing a subroutine for the staple processing;

FIG. 29 is a flowchart showing a subroutine for the ]am reset processing;

FIGS. 30 and 31 show a third embodiment according to the present invention;

FIG. 30 is a perspective view of a sheet take-out position;

FIG. 31 is a flowchart showing a subroutine for the jam reset processing; and FIG. 32 is a flowchart showing a subroutine for the sheet take-out processing in a fourth embodiment according to the Present invention.

DETAILED DESCRIPTION OF THE PREFERRED EMBODIMENTS

Embodiments of the present invention will be described below with reference to the accompanying drawings.

First Embodiment; Refer to FIGS. 1 through 24

Construction of Whole System

Figure 1:
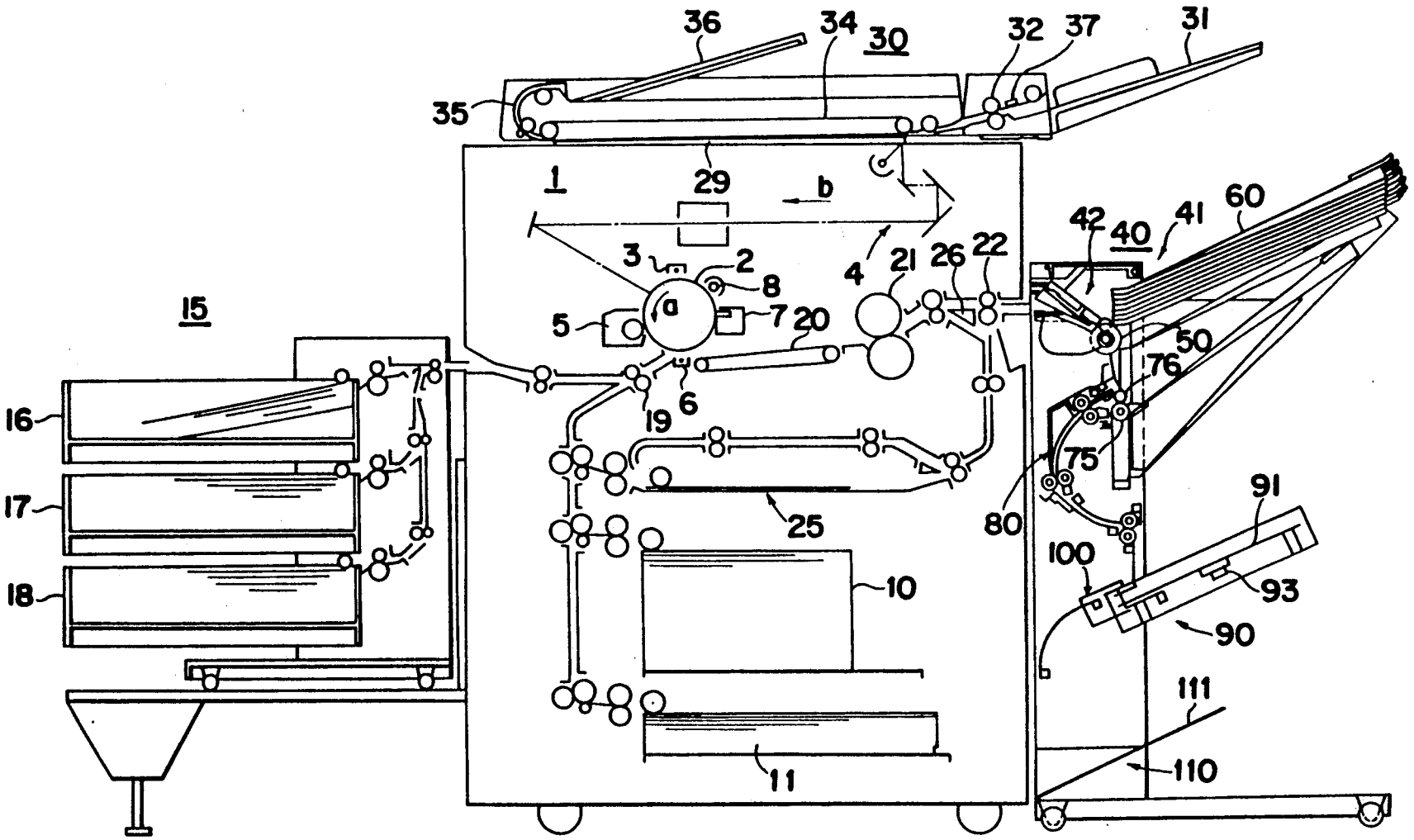
FIG. 1 is a schematic view of a copying machine and a sorter-finisher of a first embodiment.

As shown in FIG. 1, a sorter-finisher 4Q is designed to be installed on the side of a copying machine 1, and the copying machine 1 is provided with an automatic copy sheet feeding unit 15 and an automatic document feeder 30 (hereinafter referred to as ADF).

The copying machine 1 is operated on the principle of the commonly known electro-photography. In this copying machine 1, a photosensitive drum 2 to be turned in the direction of the arrow (a) is charged with a certain amount of static electricity by a static electricity charger 3, and the document set to a specified position by the ADF 30 is exposed to the light through a slit when an optical system 4 scans the document in the direction of the arrow (b). This causes an electrostatic latent image formed on the photosensitive drum 2 to be developed into a toner image by a magnetic brush type developing device 5 and then transferred onto a sheet by a transfer charger 6.

Copying sheets are fed one by one selectively from an elevator type and a cassette type automatic copy sheet feeders 10 and 11 built in the copying machine 1 or the 3-stage sheet feed cassettes 16, 17 and 18 of the automatic copy sheet feeding unit 15 installed outside the copying machine 1, and each of the sheets is transported to a transferring section by a pair of timing rollers 19 with specified timing. The sheet carrying an original image is delivered to a fixing unit 21 by a conveyor belt 20 for fixing the toner image. Then, the sheet is transported to a sorting unit 41 by a pair of ejection rollers 22 while the travel of the sheet is detected by an ejection switch SW3 (Refer to FIG. 2) provided immediately before the pair of ejection rollers 22. The copying machine 1 has a built-in sheet refeeder 25, which enables duplex copying and composite copying, and a sheet transport selection click 26 is provided before the pair of ejection rollers 22.

On the other hand, the photosensitive drum 2 is continued to turn in the direction of the arrow (a) even after the toner image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed documents placed on a document tray 31 one by one using a pair of feed rollers 32 and to set them to a specified position on a document glass 29 by the rotary motion of a conveyor belt 34. After the exposure of the document image, the document is ejected onto a tray 36 through a transfer path 35 as the conveyor belt 34 turns.

Figure 2:
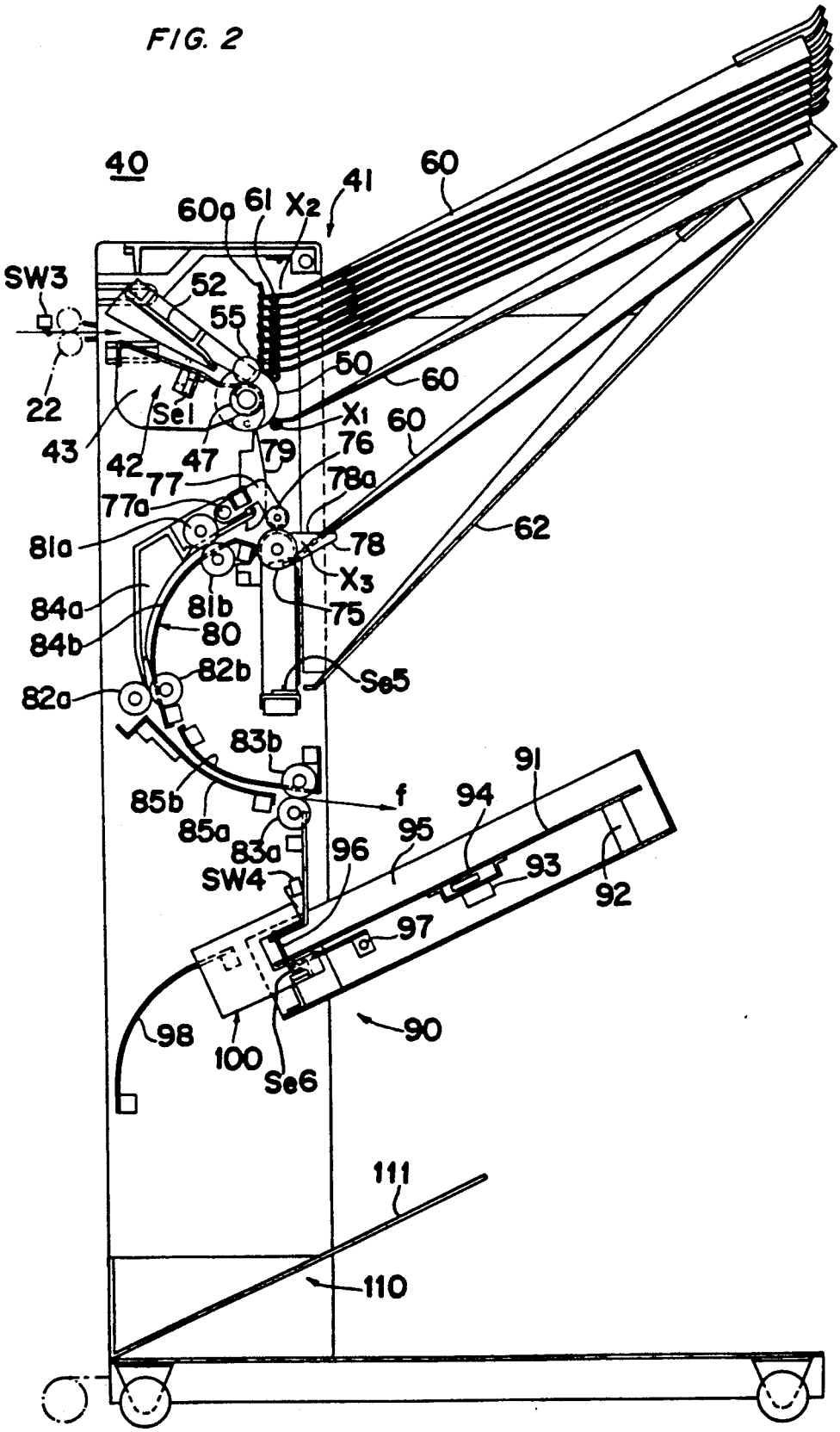
FIG. 2 is an elevational view of the sorter-finisher showing the internal construction.

As shown in FIG. 2, the sorter-finisher 40 comprises a sorting unit 41 for distributing copy sheets among bins 60, a stapling unit 90 with a stapler 100 for stapling the copy sheets and a stacking unit 110 for stacking the stapled sheets. In this sorter-finisher 40, the stapling unit 90 is disposed below the sorting unit 41, and the stacking unit 110 is disposed below the stapling unit 90.

Construction and Operation of the Sorting Unit

The construction of the sorter-finisher 41 is as described in U.S. Pat. No. 4,811,048. The construction and operation of the bins 60 are herewith described.

Figure 3:
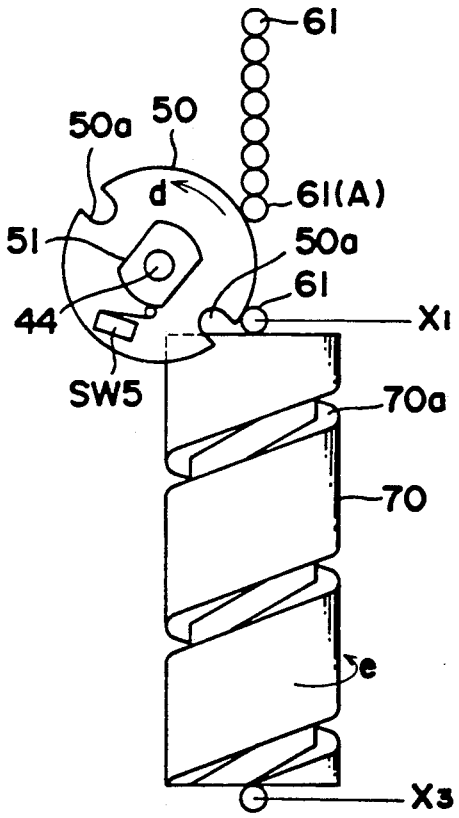
FIG. 3 is an explanatory drawing of a floating cam and a fixed cam.
Figure 4:
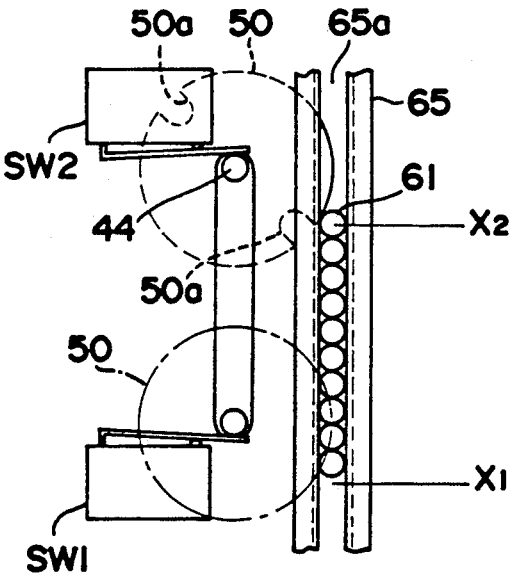
FIG. 4 is an explanatory drawing of the floating cam.

As shown in FIGS. 2 and 3, a plurality of tabs 60*a* for preventing the reverse flow of copy sheets and a pair of trunnions 61 are provided for each of the bins 60 at one end portion. Each trunnion 61 engages with a groove 65*a* extending vertically along a Pair of guide units 65 refer to FIG. 4) in order to regulate the movements of the bins 60 in the vertical direction. The other end of each of the bins 60 is supported by a bin holder 62. The trunnions 61 are moved vertically by the rotations of floating cams 50 so that the intervals of the bins 60 can be increased. The floating cams 50 are fixed on both ends of a supporting shaft 44, and each of them has notches 50*a* which are formed on the circumferential surface at intervals of 180°. These floating cams 50 are turned 180° intermittently by a different driving source from that of feed rollers 47 and support not only a lower unit 43 but also the rear ends of the bins 60 by means of the trunnions 61 which come into contact with their circumferential surfaces. Furthermore, the floating cams 50 can move up and down between a bottom bin position Xl and a top bin position X2, and the cams 50 are detected by detection switches SW1 and SWZ refer to FIG. 4) when they have reached these positions XI and X2 respectively. The lower unit 43 is provided with a photosensor gel to detect transported copy sheets. A 180° turn of the floating cams 50 is detected by a switch SW5 which Is turned on and off depending on the rotation of a cam 51 fixed by the same shaft of the floating cams 50. A transmission type photosensor Se5 whose optical axis is located at the rear end of each bin 60 is installed in the sorting unit 41 so that the presence and the absence of copy sheets distributed among the bins 60 can be detected.

In the sorting unit 41 having the above-described construction, copy sheets can be stored in three different modes. The first mode is a sorting mode wherein copies of an original document are distributed among the bins 60 so that each bin 60 will be stored with a copy set sorted in the order of page. The second mode is a grouping mode wherein copies of an original document are collected in one bin 60 to group copy sheets depending on the image. The third mode is a non-sorting mode wherein all copies are stored only in one bin 60.

The following is a description of fixed cams 70 and a transport unit 80 which are used for transporting copy sheets distributed among the bins 60 to a staple tray 91 which will be also explained later.

As shown in FIG. 3, each fixed cam 70 has a spiral groove 70*a* turning 3 times round the circumferential area of the fixed cam 70, with which the trunnions 61 come into engagement. The fixed cams 70 can be turned in both the normal direction and the reverse direction by a motor not shown in the drawings. The trunnions 61 of the bin 60 which has been shifted to the bottom bin position Xl by the rotations of the floating cams 50, come into engagement with the spiral grooves 70*a* of the fixed cams 70, and the bin 60 is lowered to a sheet take-out Position X3 as the fixed cams 70 turn in the direction of the arrow (e). A disk 88 is fixed to the lower end of the supporting shaft 71 of one of the fixed cams 70. The disk 88 has a notch (not shown) which is detected by a photosensor Se2 in order to control the number of revolutions of the fixed cams 70.

Figure 5:
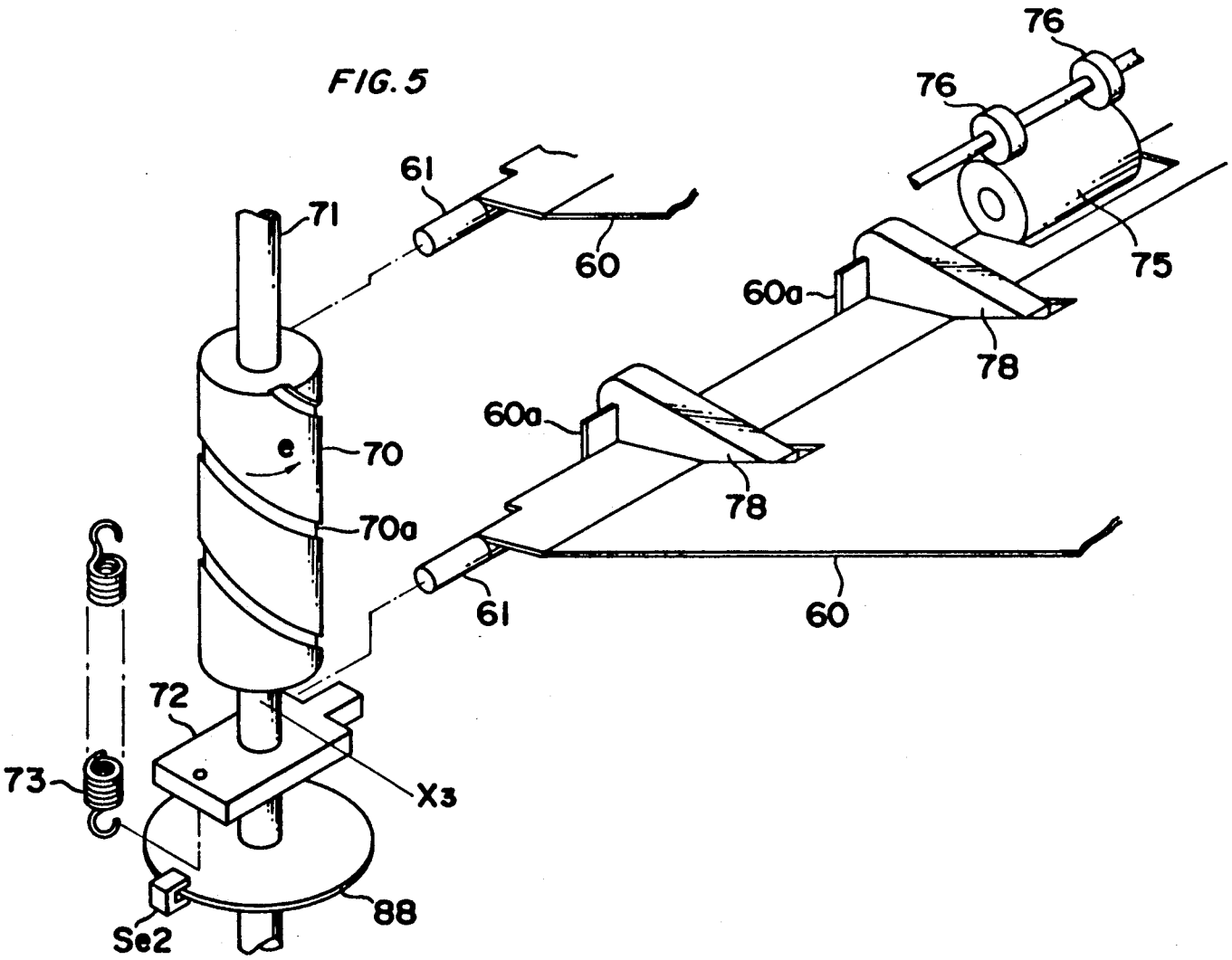

As shown in FIG. 5, at the sheet take-out position X3, receiving members 72 supported by the respective shafts 71 are hooked by coil springs 73 and can move up and down along the supporting shaft 71. The trunnions 61 descended to the take-out position X3 are received by the receiving members 72 and are supported with elasticity of the coil springs 73. In the take-out position X3, a take-out roller 75, pinch rollers 76 which are pressed against the roller 75 by the gravity and sheet guides 78 are installed. Also, as shown in FIG. 2, a sheet reverse flow prevention guide 79 is installed between the bottom bin position Xl and the take-out position X3. The pinch rollers 76, which are fitted in an arm 77, are pivoted on a shaft 77*a*, and they are kept in contact with or retracted from the roller 75 by a solenoid not shown in the drawings.

The transport unit 80 comprises the rollers 75 and 76, transport rollers 81*a*, 81*b*, 82*a*, 82*b*, 83*a* and 83*b*, and guide plates 84*a*, 84*b*, 85*a* and 85*b*. The transport rollers 81*a*, 82*a* and 83*a* are made of rubber material, while the transport rollers 81*b*, 82*b* and 83*b* are made of spongy material so that they are able to transport the various thickness of stacked sheets.

In the above-described arrangement, the fixed cams 70 are turned 3 times in the direction of the arrow (e) after the sorting unit 41 has completed the distribution of sheets. The trunnions 61 of the bin 60 at the bottom bin position Xl are guided by the spiral grooves 70*a* so that the bin 60 moves down to the take-out position X3. The take-out roller 75 overlaps with the bin 60 so that the end of the sheets are caught between the rollers 75 and 76 when the bin 60 has reached the take-out position X3, and then the sheets are transported tot he transport rollers 81*a* and 81*b* by the rollers 75 and 76. Then, the sheets are transported onto the staple tray 91 through the transport rollers 83*a* and 83*b* as indicated by the arrow (f).

Construction and Operation of the Stapling Unit

As shown in FIG. 2, the stapling unit 90 comprises the staple tray 91, a motor to vibrate the staple tray 91, a guide plate 95, a stopper 96 and a stapler 100. The staple tray 91 is oscillatably installed on a supporting shaft 92 to serve as a supporting point, and the staple tray 91 is vibrated by the centrifugal force of an eccentric weight 94 turned by the motor 93. This vibration causes the sheets transported from the transport unit 80 to be regulated by the guide plate 95 and the stopper 96.

The stopper 96 is installed on a supporting shaft 97 to serve as a supporting point so that the stopper 96 can be turned by a solenoid not shown in the drawings. The stopper 96 is normally located on the lower end of the staple tray 91 to determine the lower edge of the sheets. When the solenoid is turned on, the stopper 96 retreats downward to cancel the sheet positioning.

The stapling unit 90 is provided with a photosensor Se6 for detecting the presence or the absence of sheets on the staple tray 91 and a switch SW4 for detecting the mounting and the dismounting of the stapler 100.

In the above-described arrangement, the staple tray 91 is vibrated by the revolution of the motor 93, and the vibration of the tray 91 causes the sheets transported from the transport unit 90 onto the staple tray 91 to be aligned by the guide plate 95 and the stopper 96. When the motor 93 stops, the staple motor is driven to staple the sheets. When the solenoid is turned on to withdraw the stopper 96 from the tray 91, the stapled sheets slide down onto a stack tray 111 by being guided by a plate 98. Such stapling operation is repeated each time one of the bins 60 is moved down to the take-out position X3 by the fixed cams 70 so that the sheets in the bin 60 are carried onto the staple tray 91.

Operation Panels

In this embodiment, operations panels are installed at three places, a copying machine panel 120, an ADF panel 140 and a sorter panel 150 as shown in FIGS. 6, 7 and 8 respectively.

The copying machine panel 120 comprises a print key 121 for starting the copying operation when the ADF 30 is not used, an interruption key 122 for interrupting the multiple copying operation temporarily, a clear/-stop key 123 for stopping the copying operation for canceling the inputted number of copy sets, a ten key group 124 for setting the number of copy sets, an indicator 125 for indicating the number of copy sets and the condition of the copying machine 1, up/down keys 126 and 127 for setting the density for copy images, LEDs 128 for indicating the density for copy images, a sheet selection key 129 for selecting the sheet size, LEDs 130 for indicating said sizes, a magnification selection key group 131 for selecting the copying magnification and an LED group 132 for indicating said magnifications.

Only a start key 141 for starting the ADF 30 is installed on the ADF panel 140. When this start key 141 is turned on, documents on the document tray 31 are automatically transported one by one onto the document glass 29, and the copying operation is started.

The sorter panel 150 comprises a sorter mode selection key 151, a non-sorting mode indication LED 152, a sorting mode indication LED 153 and a grouping mode indication LED 154 which are the indicators of a mode selected with the sorter mode selection key 151, a finishing mode selection key 155, a non-finishing mode indication LED 156 and a finishing mode indication LED 157 which are the indicators of a selected mode with the finishing mode selection key 155, a finishing start key 158 and an LED 159 as the indicator of the condition of a finishing operation. The LED 159, when it is lighted, indicates that a finishing operation is in progress, and when it is flicking, alarms an operator of the necessity of taking sheets out of the staple tray 91 or the stack tray 111. The sorter panel 150 further comprises an LED 160 for alarming an operator of the necessity of taking sheets out of the bins 60, an LED 161 for alarming an operator of no staples and an LED 162 for alarming an operator of the poor setting of the stapler 100.

The sorter mode is changed to the non-sorting mode, sorting mode and grouping mode in rotation, each time the key 151 is depressed, and the corresponding LEDs 152, 153 and 154 are lighted accordingly. The finishing mode is changed to the non-finishing mode and finishing mode alternately, each time the key 155 is depressed, and the corresponding LEDs 156 and 157 are lighted accordingly. Each time the finishing start key 158 is depressed, a signal for starting a finishing operation and a signal for canceling the finishing operation are generated alternately, and the LED 159 lights when the key 158 is depressed to start a finishing operation.

The sorter panel 150 furthermore has a jam reset switch 165. In case that a trouble such as a paper jam occurs while copy sheets are transported from the bin 60 at the sheet take-out position X3 to the staple tray 91, the switch 165 is turned on after the removal of the jammed paper by an operator. When the switch 165 is turned on, the sorter-finisher 40 recovers from the paper jam, and the finishing operation is resumed with the next bin.

Control Circuit

FIG. 9 is a block diagram of the control circuit wherein a microcomputer (hereinafter referred to as CPU) is connected to the copying machine panel 120, the ADF panel 140, the sorter panel 150, a copy processing unit 170, an ADF processing unit 171, a sorter processing unit 172 and a finisher processing unit 173 so that the signals can be exchanged with each other.

FIG. 10 shows the essential part of the control circuit wherein the input/output port of the microcomputer is connected to the print switch 121, the ADF start switch 141 and their built-in indicator LEDs 180 and 181, various selection switches of the sorter panel 150, various indicator LEDs, etc.

Control Procedure

Here, the control procedures of the copying machine 1 and the sorter-finisher 40 based on the control circuit will be explained in reference to FIGS. 11 through 24.

In the following paragraphs, the term "on-edge" is defined as change in status, where the switch, sensor, signal or the like changes from the off status to the on status. In contrast, the term "off-edge" represents change in status, where the switch, sensor, signal or the like changes from the on status to the off status.

FIG. 11 shows a main routine of the CPU.

When the CPU is reset, and the program is started, at step S1 the clearance of a random access memory and the initialization (or the setting for initial mode) of all registers and units take place. An internal timer starts at step S2. The internal timer is for setting the time required for the execution of the main routine, which is to be set in advance at the time of initialization at step S1.

Various subroutines, which will be explained later, are called one by one at steps S3 through S8a. When the execution of all the subroutines are completed, the processing returns to the step S2 after the time set by the internal timer has passed at step S9. The time required for one routine is used in making various counting with various counters during the execution of the subroutines.

Incidentally, a jam flag is checked with "1" or not at step S3a in this main routine, and when the flag is "1", the processing goes to step S8a immediately where a subroutine for recovering from a paper jam is executed. The jam flag is set to "1" when the occurrence of a paper jam is detected during transportation of sheets from one of the bins 60 to the staple tray 91 under a sheet take-out subroutine which will be described later (refer to step S301 in FIG. 22).

FIGS. 12*a* and 12*b* show a subroutine for the input processing to be executed at step S3 in the main routine.

First, a set number (A) is inputted with the ten key group 124 on the copying machine panel 120 at step S10. Then, a selected sheet size (Sx) is entered at step S11, and it is checked at step S12 whether the ADF 30 is to be used. When the ADF 30 is to be used, an ADF mode flag is set to "1" at step S13, and when it is not to be used, the ADF mode flag is reset to "0" at step S14.

A subroutine for setting the sorter mode is executed at step S15. A subroutine for setting finishing mode is executed at step S16, and at step S17, whether the sorting mode flag is "1") or not is checked. When the sorting mode flag is "0", the sorting and stapling operations will not be executed, so that the processing goes to step S22. When the sorting mode flag is "1", the bin number (a) is entered at step S18, and the set number (A) and the bin number (a) are compared at step S19. When the set number (A) is smaller than the bin number (a), the operation in the sorting mode is possible, and then whether the finishing mode flag is "1" or not is checked at step S20. When the finishing mode flag is "0", the processing goes to step S22, and hen it is "1", it is checked at step S21 whether the selected sheet size (Sx) is either A4 size of B5 size, or another size. As described above, the sheet sizes allowed for stapling operation are A4 size and B5 size. When the sheet size (Sx) is either A4 size or B5 size, other input processing is executed at step S22, and when the sheet size (Sx) is another size, the processing goes to step S31.

Further, whether the print switch 121 is turned on or not is checked at step S23. When it is turned on, a copying flag is set to "1" at step S24 to allow the copying operation. When it is not turned on, whether the ADF start switch 141 is turned on or not is checked at step S25. When it is turned on, the processing at said step S24 is executed, and when it is not turned on, the subroutine is terminated.

On the other hand, when the set number (A) is judged to be larger than the bin number (a) at said step S19, an alarm flag F1 is set to "1" at step S26, and the operation of the system is inhibited at step S27. The alarm flag F1 is for indicating that the number of copy sets to be made is over the number of the bins 60. At steps S28 and S36, whether the print switch 121 and the ADF start switch 141 and turned on respectively are checked in the same manner as that said steps S23 and S25. When the result either at step S28 or S36 is "Yes", that is, when the operator's will for executing the copying operation regardless of the alarm signal is confirmed, a non-sorting mode flag is set to "1" at step S29, and the alarm flag F1 is reset to "0" at step S30. Then, the inhibition of the system operation is canceled at step S30*a*, and the copying flag is set to "1" at step S37.

Further, when the sheet size (Sx) is judged to be neither A4 size nor B5 size at said steps S21, the stapling operation is not possible, so that an alarm flag F2 is set to "1" at step S31, and the operation of the system is inhibited at step S32. The alarm flag F2 is for indicating that the selected sheet size is not fit for a stapling operation. Then, the print switch 121 and the ADF start switch 141 are checked whether on or not at steps S33 and S38 respectively in the same manner as those at said steps S23 and S25. When the operator's will for executing the copying operation regardless of the alarm signal is confirmed at step S33 or step S38, the finishing mode flag is reset to "0" at step S34, and the alarm flag F2 is reset to "0" at step S35. The inhibition of the system operation is canceled at step S35*a*, and the copying flag is set to "1" at step S39.

FIG. 13 shows a subroutine for the sorter mode setting to be executed at said step S15.

In the subroutine, first, it is checked at step S40 whether or not the sorter mode selection key 151 is changed from off to on. When the result is "No", the subroutine is terminated at once. When the result is "Yes", the non-sorting mode flag and the sorting mode flag are checked whether "1" or not at steps S41 and S43 respectively. When the non-sorting mode flag is "1", the sorting mode flag is set to "1" at step S42. When the non-sorting mode flag and the sorting mode flag are "0" and "1" respectively, a grouping mode flag is set to flag "1" at step S44. When both the non-sorting mode flag and the sorting mode flag are "0", the non-sorting mode flag is set to "1" at step S45.

FIG. 14 shows a subroutine for the finishing mode setting to be executed at said step S16.

First, it is checked at step S50 whether or not the finishing mode selection key 155 is changed from off to on. When the result is "No", the subroutine is terminated at once. When the result is "Yes", at step S51, whether or not the finishing mode flag is "0" is checked. When the flag is "0", that means the finishing mode has not been selected, the finishing mode flag is set to "1" at step S52. Then, allowable stapling number (Cb) is set at step S53. The allowable sheet size for stapling is set to A4 and B5 at step S54. The sorting mode flag is set to "1" at step S55 for allowing the operation in the sorting mode.

On the other hand, at said step S51, when the finishing mode flag is judged to be "1", that means the finishing mode has been selected, the finishing mode flag is reset to "0" at step S56. Then, the setting of the allowable stapling number (Cb) is canceled at step S57. The allowable sheet size for stapling is canceled at step S58. The sorting mode flag is reset to "0" at step S59, and the operation in the sorting mode is inhibited.

FIGS. 15*a*, 15*b*, 15*c* and 15*d* show a subroutine for the indication processing to be executed at step S4 in the main routine.

First, whether the ADF mode flag is "1" or not is checked at step S60. When it is "1", the LED 180 for indicating the non-ADF mode is turned off at step S61*a*, and the LED 181 for indicating the ADF mode is turned on at step S61*b*. When the ADF mode flag is "0", the LED 180 is turned on at step S62*a*, and the LED 181 is turned off at step S62*b*.

Further the non-sorting mode flag and the sorting mode flag are checked whether "1" or not at steps S63 and S65 respectively. When the non-sorting mode flag is "1", the LED 152 for indicating the non-sorting mode is turned on at step S64*a*, and the LEDs 153 and 154 are turned off steps S64*b* and S64*c*. When the sorting mode flag is "1", the LED 152 is turned off at step S66*a*, the LED 153 for indicating the sorting mode is turned on at step S66*b*, and the LED 154 is turned off at step S66*c*. When said two flags are "0", the LEDs 152 and 153 are turned off at steps S67*a* and S67*b*, and the LED 154 for indicating the grouping mode is turned on at step S67*c*.

Next, at step S68, whether the finishing mode flag is "1" or not is checked. When it is "1", the LED 156 for indicating the non-finishing mode is turned off at step S69*a*, and the LED 157 for indicating the finishing mode is turned on at step S69*b*. When the finishing mode flag is "0", the LED 156 is turned on at step S70*a*, and the LED 157 is turned off at step S70*b*. At step S71, whether the finishing processing flag is "1" or not is checked. The finishing processing is defined as a series of processing that the sheets distributed among the bins 60 in the sorting unit 40 are ejected therefrom to be transported onto the stapling tray 91 by the transport unit 80, aligned and stapled by the stapler 100 thereon and finally stacked in the stack tray 111. The finishing processing flag is kept "1" while the series of processing as mentioned above is executed. Accordingly, when the finishing processing flag is "1", the LED 159 for indicating the finishing processing has started is turned on at step S71*a*. When it is "0", the LED 159 is turned off at step S71*b*.

Further, at step S73, the alarm flag F1 is checked whether "1" or not. When the flag F1 is "1", the indicator 125 indicates that the set number is larger than the number of bins at step S74*a*. When the flag F1 is "0", the indication on the indicator 125 is turned off at step S74*b*. AT step S75, the alarm flag F2 is checked whether "1" or not. When the flag F2 is "1", the indicator 125 indicates that the sheet size is inappropriate at step S75*a*. When the flag F2 is "0", the indication on the indicator 125 is turned off at step S75*b*. At step S76, the alarm flag F3 is checked whether "1" or not. When the flag F3 is "1", the indicator 125 indicates that the finishing mode is not available at step S76*a*. When the flag F3 is "0", the indication on the indicator 125 is turned off at step S76*b*. At step S77, the alarm flag F4 is checked whether "1" or not. When the flag F4 is "1", the indicator 125 indicates the absence of documents at step S77*a*. When the flag F4 is "0", the indication on the indicator 125 is turned off at step S77*b*. At step S78, the alarm flag F5 is checked whether it is "1" or not. When the flag F5 is "1", the indicator 125 indicates that the number of sheets in each bin is over the finishing capacity at step S78*a*. When the flag F5 is "0", the indication on the indicator 125 is turned off at step S78*b*. At step S79, the alarm flag F6 is checked whether "1" or not. When the flag F6 is "1", the LED 159 is flickering at step S79*a* to indicate that the sheets need to be removed from the staple tray 91. When the flag F6 is "0", the LED 159 is turned off at step S79*b*. At step S81, the alarm flag F11 is checked whether "1" or not. When the flag F11 is "1", the LED 160 is turned on at step S81*a* to indicate that the sheets need to be removed from the bins 60. When the flag F11 is "0", the LED 160 is turned off at step S81*b*.

Further, whether the copying flag is "1" or not is checked at step S82. The indicator 125 indicates the number of copied sheets S82*a* when the copying flag is "1", and the number of left for copying is indicated at step S82*b* when is "0". Subsequently, other indication process executed at step S83, and this subroutine is FIG. 16 shows for the processing of copying system to be execute step S5 of the main routine First, whether ADF mode flag is "1" or not is checked at step S9 it is "1", whether the copying flag is "1" or not i at step S91. Since the copying flag operation is allow the copying flag is "1", a subroutine for the of the ADF 30 is executed at step S95, and the proceed to step S97. When the ADF mode flag is judged to be "0" at said step S90, whether the copying flag is "1" is checked at step S96. When it is "1", the processing to step S97. When the copying flag is judged to be "0" at step S91 or at step S96, the processing returns main routine.

The non-sorting flag and the sorting mode flag are checked whether "1"or not at steps S97 and S100 respectively. When non-sorting mode flag is "1", a subroutine for the non-sorting mode Processing is executed at step S99, and when the sorting mode flag is "1", a subroutine for the sorting mod - is executed at step S101 on the other hand, when the non-sorting mode flag and the sorting mode flag are "0", a subroutine for the grouping mode processing is executed step S104. Further, a subroutine for the copying operation is executed at step S105, and a subroutine for other processing is executed at step S106.

The subroutine be executed at said steps S99 a d S104 are performed in conventional procedures, so that the detailed description procedures is omitted here.

FIG. 17 shows for the ADF control to be executed at said st

First, whether are present in document tray 31 or not is checked action of the sensor 37 at step S120. When document present, whether the alarm flag F4 is "1" or not is step S133. This flag F4 is set to "1" at step S131 which will be explained later, but when the flag F4 is "1", it is to reset to "0" at step S134. Then, a document supply processing subroutine at step S121, a document size subroutine at step S122 and a document processing subroutine at step S123 are executed . When the documents have run out, it is checked at whether the document counter registers "0" or the counter registers "0", the alarm flag F4 is set to "1" at step S131 the copying flag is reset to "0" at step S132, and the processing returns to the main routine.

Also, it is at step S124 whether the optical system 4 has scanned document for the same number of times as the number of co be made. When the result is "Yes", a scanning completion flag is set to "1" at step S125. Then, after it is con at step S126 that the scanning completion flag is set to "1", the scanning completion flag is reset to "0" at 27. A document ejection processing subroutine is executed step S128. Subroutines for other processing are executed step S129.

Further, the subroutine is similar to the conventional one, the detailed description of the subroutines to be at said steps S121, S123 and S128 is omitted here.

FIGS. 18*a*, 18*b*, 18*c* and 18*d* show a subroutine for the sorting mode process be executed at said step S101. In this subroutine, w the finishing mode is selected or not varies the motion sorter bins 60. This is because the order of sheets among the bins 60 corresponds to the taking the sheets out of the bins 60, and these order dependent on whether the finishing mode is selected or the finishing mode is selected, the sheet distribute with the bottommost bin and proceeds toward t bin so that the sheets can be transported to the - unit 90 smoothly, and when the finishing mode is n , the sheet distribution starts with the topmost b proceeds toward the bottommost bin so that the take sheets out of the bins 60 easily.

More particular the finishing mode flag is "1" or not is check step S140. When it is "1", whether the presence of the bins 60 is checked by the on-off signal of the Se5 at step S141. When there are no sheets, the alarm F11 is checked whether "1" or not at step S141*a*. This alarm flag F11 is set to "1" at steps S158 and S161 which will ned later. When the alarm flag F11 is "1", it is reset to "0" at step S141*b*, and the inhibition of the system operation is canceled at step S141*c*. Then, it is check step S142 whether the bottom bin detection switch SW1 is turned on or not, that is, whether or not the bins 60 ar bottom bin position Xl, the home position of the bin the finishing mode where the bins 60 are ready for re sheets in the finishing mode. When the result is Yes pressing goes to step S148, and a direction-of-rotation is reset to "0" in order to move the bin 60 for the operation, that is, to reverse the rotation of a float motor not shown in the drawings). When the result is step 8142, the processing at steps S143 through S147 ed to shift the bins 60 to the bottom bin Position First the floating cam motor is rotated in the norm at step 8143, and sorter wait is applied at step sorter wait means the inhibition of the copying open so that sheets are not transported into the sorting while the bins 60 are in motion. When it is configuration step S145 that the bottom bin detection switch SW on, the floating cam motor is turned off at step sorter wait is canceled at step S147. The direction on flag of the floating cam 50 is reset to "0" at 48 in order to reverse the rotation of the floating cam On the other hand, when the finishing mode is not selected, the present sheets in the bins 60 is checked by the on-off signal o Se5 at step S149. When there are no sheets, the detection switch SW2 is checked whether on or not S150, that is, whether or not the bins 60 are at the position X2, the home position of the bins 60 in the mode, where the bins 60 are ready for receiving in the non-finishing mode. Thus, when the result is "Yes", the processing proceeds to step S156, and the direct flag for the floating cam 50 is set to "1" to permit the normal rotation of the floating cam 50 so Permit the distributing operation. When the result S149 is "No", the series of processing at step through S155 is executed to shift the bins 60 to the position X2. First, the floating cam motor is rotate reverse direction at step S151, and the sorter w applied at step S152. When it is confirmed at step S the top bin detection switch SW2 is turned on, the f cam motor is turned off at step S154. Then, the sort is canceled at step S155, and the direction-of-rotation of the floating cam 50 is set to "1" at step S156 t the floating cam 50 rotate in its normal direction her When the pres sheets in the bins 60 is detected either at step S141 step S149, it is checked either at step S157 or S160 the sheet counter registers "0". When the counter registers "0", the alarm flag F11 is set to "1" at step S158 or S161 in order to prepare for lighting the LED 160 to indicate the need of removing the sheets. The system operation is at steps S159 or S162, and the processing returns to the main routine.

Next, at step S163, the ejection switch SW3 of the copying machine 1 whether on-edge or not. When the leading end of reaches the ejection switch SW3, the sorter transport is turned on at step S164, and the sorter ejection sen is checked whether off-edge or not at step S165. When end of the sheet has passed the ejection sensor is judged that the sheet has been transported into the bins 60. Therefore, when the ejection sensor S -edge, the timer of the sorter transport motor i at step S166. Then, the sheet counter gains an in at step S167. When it is confirmed at step S168 that of the sorter transport counts up, the sorter tray motor is turned off at step S169. Subsequently, whet latest transported sheet is the last sheet or not i at step S170. When it is judged to be the last she direction-of-rotation flag of the floating cam 50 is at step S171. That is, when the direction-of-rotation of the floating cam 50 has been "0", it is set to "1", when it has been "1", it is reset to "0". When said s not judged the last sheet at said step S170, the flag of the floating cam 50 is checked at s in order to continue the sorting operation. When the is "0", the floating cam motor is rotated in the revel at step S173, and when it is "1", the motor is in the normal direction at step S174. Sheets are among the bins 60 during the reciprocating motion the top bin and the bottom bin.

Then, the finishing mode flag is checked whether "1" or not at step S175. When it is "1", the number (M) of sheets per bin is calculated at step S175*a*, and the number (M) and the stapling capacity (Cb) (refer to step S53) are compared at step S176. When the number (M) is over the stapling capacity (Cb), the alarm flag F5 is set to "1" at step S177 to indicate the excessive sheets over the stapling capacity, which may prevent defective stapling Further, the copying flag is reset to "0" at step S178. The print switch 121 the ADF start switch 141 are checked whether on or not at step S179 and at step S180 respectively. When either the print switch 121 or the ADF start switch 141 is on, that is, when the operator's will for the execution of the copying operation regardless of the alarm is confirmed, the finishing mode flag is reset to "0" at step S181, the alarm flag F5 is reset to "0" at step S182, and the copying flag is set to "1" at step S183 for enabling the execution of the processing in the sorting mode. Then, this subroutine is completed When the operator wants to terminate the copying operation and execute the finishing processing at the time of being given the alarm of the oversupply of sheets during the execution of the processing at steps S176 and S177, the operator is required only to turn on the finish start switch 158 (refer to steps S206 and S207).

FIG. 19 shows a subroutine for the copying operation processing to be executed at said step S105.

First, it is checked at step S!90 whether the optical system 4 has scanned a document for the same number of times as the number of copies to be made. When the result is "Yes", the scanning completion flag is set to "1" at step S191. When the result is "No", a subroutine for the Processing of copying process is executed at step S192. This subroutine is designed for the execution of the ordinary copy process by the copying machine 1. The detailed description of this subroutine is omitted here.

Then, after confirming that the scanning completion flag is "1" at step S193, the scanning completion flag is reset to "0" at step S194 the copying flag is reset to "0" at step S195, and a subroutine for other processing is executed at step S196.

FIGS. 20*a* and 20*b* show a subroutine for the finishing processing to be executed at step S6 in the main routine.

First, whether the finishing mode flag is "1" or not is checked at step S200. When it is "0", the processing is terminated at once. When it is "1", whether a finishing mode inhibition flag is "1" or not is checked at step S201. When it is "0", the processing goes to step S206. When it is "1", the presence of sheets on the staple tray 91 is checked by the on/off signal of the sheet detection sensor Se6 on the staple tray 91 at step S202. When the sheets detection sensor Se6 is on, that means there are sheets on the tray 91, the alarm flag F6 is set to "1" at step S202*a* in order to indicate the need of removing the sheets from the staple tray 91, which may prevent troubles such as the mixing and stapling of the sheets already stacked on the staple tray 91 together with sheets to be transported thereon later and the excessive supply of the sheets over the stapling capacity of the stapling unit 90.

On the other hand, when it is confirmed at step S202 that there are no sheets on the staple tray 91, the finishing mode inhibition flag is reset to "0" at step S203 in order to cancel the inhibition of the finishing mode operation. Next, the alarm flag F6 is checked whether "1" or not at step S204. When it is "1", the flag F6 is reset to "0" at step S205. When it is "0", the processing goes to step S206.

Next, it is checked at step S206 whether or not the finishing start switch 158 is changed from off to on. When the switch 158 is changed to on, at step S207 the finishing processing flag is checked whether "0" or not. When the finishing processing flag is "1", that is, the finishing mode has been currently selected, the finishing processing flag is reset to "0" at step S207*a*, and the processing goes to step S209. When the finishing processing flag is "0", that is, the switch 158 has been turned on to select the finishing mode, the presence of sheets are on the staple tray 91 is checked again at step S208 by the on/off signal of the sensor Se6. When there are sheets, the processing at steps S208*b*, S208*c* and S208*d* are executed not only for giving an alarm but also for canceling the finishing mode so that the troubles as described above, such as stapling unnecessary sheets and defective stapling can be prevented. Concretely, the alarm flag F6 is set to "1" at step S208*b* in order to prepare for indicating the necessity of removing the sheets from the staple tray 91. Then, the finishing mode inhibition flag is set to "1" at step S208*c*, the finishing processing flag is reset to "0" at step S208*d* to cancel the stapling operation, and the processing goes to step S209. When there are no sheets, the finishing processing flag is set to "1" to execute the finishing operation at step S208*a*, and the processing goes to step S209.

At step 209, the number (M) of sheets per bin is calculated. At step S210, whether the number (M) is "1" or not is checked. When only one sheet is distributed into each of the bins 60, there is no need of stapling. Thus, when the number (M) is found to be "1" at said step 8210, the alarm flag F3 is set to 37 1" at step S210*a* in order to prepare for indicating that the finishing mode is impossible. Simultaneously, the finishing mode flag and the finishing processing flag are reset to "0" at steps S210*b* and S210*c* to cancel the finishing mode, and the subroutine is terminated.

On the other hand, when it is confirmed that the number (M) is not "1", whether the alarm flag F3 is "1" or not is checked at step S211. When the flag F3 is "1", the flag F3 is reset to "0" at step S212. Next, at step S213, it is checked whether the finishing Processing flag is "1" or not, and when the flag is "0", the subroutine is terminated. When the flag is "1", the finishing processing is executed. That is, a subroutine for the bin transport processing at step S214, a subroutine for the sheet take-out Processing at step S215 and a subroutine for the staple processing at step S216 are respectively executed. Then, when the series of processing has been completed, the presence of sheets in each of the bins 60 is checked at step S217, and the presence of sheets on the staple tray 91 is checked at step S218. When there are sheets neither in the bins 60 nor on the staple tray 91, the finishing processing flag is reset to "0" at step S219.

Further, in the finishing processing subroutine, when it is confirmed at step S202 that the sheets have been removed from the staple tray 91 and then the alarm flag F6 is reset to "0" at step S205, the inhibition of the finishing mode is canceled. The finishing processing is resumed by the input with the finishing start switch 158 after canceling the inhibition of the finishing mode, and also an automatic resumption of the processing is possible by using a timer.

FIG. 21 shows a subroutine for the bin transport Processing to be executed at said step S214.

First, he presence of sheets in the bins 60 is checked by the on off signal of the sensor Se5 at step S220. When there are no sheets in the bins 60, the processing is terminated at once. Actually, such a condition cannot occur unless the operator takes the sheets out of the bins 60 immediately after a copying and sorting operation. When there are sheets in the bins 60, whether the bottom bin detection switch SW1 is on or not is checked at step 8221. When the switch SW1 is not on, the motor of the floating cam 50 is turned on in its normal direction at step S222 in order to shift the floating cam 50 to the bottom bin position Xl, and said motor is turned off at step S224, when it is confirmed that the switch SW5 for detecting the rotation of the floating cam 50 is off-edge at step S223. These steps S222, S223 and S224 are repeated until the floating cam 50 reaches to the bottom bin position Xl so that the bins 60 are moved to the bottom bin position X].

When the floating cam 50 is moved to the bottom bin position Xl, that is, it is judged at step S221 that the bottom bin detection switch SW1 is turned on, the fixed cam motor is turned in its normal direction at step S225, and whether the sensor Se2 for detecting the rotation of the fixed cam 70 is on-edge or not is checked at step S226. When it is on-edge, that means one of the bins 60 positioned at the bottom bin position Xl has been moved to the sheet takeout position X3, this causes an increment of the bin counter at step S227, and the fixed cam motor is turned off at step S228.

Next, it is judged at step S229 whether or not the reading of the bin counter is equal to the set number (A) (refer to step S!0). When the reading of the bin counter is smaller than the set number A), the processing for letting the next bin 60 move to the sheet take-out position X3 is executed. That is, the rotation of the floating cam motor is reversed at step S230, and when the off-edge of the switch SW5 for detecting the rotation of the floating cam motor is confirmed at step S231, the floating cam motor is turned off at step S232. This causes the next bin 60 to move to the bottom bin position X1. These steps S230, S231 and S232 will be repeated until the reading of the bin counter becomes equal to the set number (A)

When the reading of the bin counter has become equal to the set number (A), the stapling operation is completed, and a subroutine for resetting the bin position is executed at step S234 after confirming that no sheets are in the bins 60 at step S233.

FIG. 22 shows a subroutine for the sheet take-out processing to be executed at said step S215. This subroutine is for the execution of the processing for taking the sheets out of the bin 60 which has been brought down to the sheet take-out position X3 and transporting the sheets to the staple tray 91 by the sheet transport unit 80.

First, the presence of sheets in the bin 60 which is coming down to the sheet take-out position X3 is checked by the on/off signal of the sensor Se5 at step S240. When there are no sheets in the bin 60, an alarm is given by the system not shown in the flow charts, and the processing proceeds to step 8246. When the Presence of sheets is confirmed, whether or not the fixed cam rotation detection sensor Se2 is off-edge, that is, whether the fixed cam 70 has started to turn in its normal direction or not is checked at step S241. When it is judged to be off-edge, or when the bin 60 has begun moving down to the sheet take-out position X3, the solenoid of the pinch roller 76 is turned on at step 8242, and the pinch roller solenoid timer is started at step 8243. The sheets in the bin 60 is inserted between the take-out roller 75 and the pinch rollers 76 at the sheet take-out position X3 when the sheet is caused to come down as the fixed cam 70 turns in its normal direction.

Then, whether the fixed cam rotation detection sensor Se2 is on-edge or not, that is, whether the bin 60 has descended completely to the sheet take-out position X3 is checked at step S244. When it is judged to be on-edge, the sheet take-out motor is turned on at step S245, and this causes the sheets to be transported to the staple tray 91 by the rollers 75, 76, 81*a* and 81*b*. Simultaneously, a jam detection timer is started at step S245*a*. In this timer a time required for a sheet to be transported from the bin 60 onto the staple tray 91 with a margin is set. When the expiration of the time set by the solenoid timer of pinch rollers 76 is confirmed at step S246, the pinch roller solenoid is turned off at step S247. Thereby, the pinch rollers 76 withdraw upward away from the take-out roller 75. This is because the pinch rollers 76 need to move away from the sheet take-out position X3 before the next bin 60 starts to descend from the bottom bin position Xl so that the interference with the sheets distributed among the bins 60 can be prevented.

The supply of the sheets to the staple tray 91 is confirmed at step S248 by sensor 8e6, which is turned on when he sheets are supplied, the sheet take-out motor is turned off at step S249, and the jam detection timer is reset at step S303. Then, this subroutine is completed. However, when the sensor SE6 is not on at step S248, it is checked at step S300 whether the jam detection timer counts up or not When the timer is not judged to expire, the processing returns to the main routine. When the expiration of the timer is confirmed at step S300, it means a defect in the sheet transportation, which may be caused by the occurrence of a Paper jam in the transporting unit 80, the discharge of the sheets the bin 60 by an operator or the like. Therefore, a am flag is set to "1" at step S301, all the motors are turned off at step S302, and the jam detection timer is reset at step S303. Then, this subroutine is completed.

FIG. 23 shows a subroutine for the staple processing to be executed at said step S216.

First, whether the sensor e6 of the staple tray 91 is on-edge or not is checked at step S251. This sensor Se6 is turned on when sheets are transported onto the tray 91. Thus. when said sensor 8e6 is on-edge, the vibration motor 93 is turned on at step S252 in order to jog the sheets on the tray 91, and the timer of the vibration motor is started at step S253. On the other hand, when the sensor Se6 is not judged on-edge at step S251 and is judged on at step S254, that is, when the sheets are already placed on the tray 91, the processing goes to step S255.

After it is confirmed at step S255 that the time set by the timer of the vibration motor has passed the vibration motor is turned off at step S256, and the staple motor is turned on at step S257. When a sensor which detects the revolution of the staple motor is judged on-edge at step S259, that is, when the sheets are bound with the staple 106 following the movement of the head 105, the stapling motor is turned off at step S260, and the stopper solenoid is turned on at step S262. This causes the stopper 96 to withdraw from the tray 91, and the sheets slide down onto the stack tray 111.

Then, when the sensor Se6 of the staple tray 91 is judged off-edge at step S263, or when the ejection of the sheets from the staple tray 91 into the stack tray 111 is judged, the stopper solenoid is turned off at step S264 to return the stopper 96 on the tray 981, and this subroutine is completed.

FIG. 24 shows a subroutine for the jam reset processing to be executed at step S8*a* in the main routine.

First, at step S310 the jam flag is checked whether "1" or not. When it is "0", the processing returns to the main routine. When it is "1", at step S311 a jam reset switch 165 is checked whether on-edge or not. When it is on-edge, which means that the switch 165 has turned on after the removal of the jammed paper by an operator, at step S312 the jam flag is reset to "0". Then, this subroutine is completed.

Thus, in the first embodiment, under the sheet take-out subroutine, (refer to FIG. 22), in case that the occurrence of a trouble such as a paper jam is detected while sheets are transported from one of the bins 60 onto the staple tray 91 ("YES" at step S300), the operation of the sorter-finisher 40 is discontinued refer to steps S301 and S302). After the sorter-finisher 40 recovers from the trouble by the removal of the jammed sheets from the bin, the jam reset switch 165 is turned on. When the operation is resumed by the turning-on of the jam reset switch 165, the results at step S206 and step 213 in the finishing subroutine refer to FIGS. 20*a* and 20*b*) are "NO" and "YES" respectively. Accordingly, the processing at steps S214, S215 and S216 is carried out toward the bin next to the bin where the trouble occurred. Thus, the bin where the trouble occurred is skipped in resuming the finishing operation.

Second Embodiment: Refer to FIGS. 25 through 29

As shown in FIG. 25, the sorter panel 150 has a retry switch 166 as well as the jam reset switch 165, so that in resuming the operation in the finishing mode after the occurrence of a paper jam during the sheet transportation from one of the bins 60 onto the staple tray 91, an operator can select the bin where the paper Jam occurred or the next bin as a bin with which the finishing processing is resumed with. When the operator sets the jammed sheets in the bin again as treatment of the paper jam, the operator should turn on the retry switch 166 before turning on the Jam reset switch 165. Thereby, the finishing processing is resumed with the bin where the paper jam occurred. On the other hand, when the operator takes the sheets out of the bin as treatment of the paper jam, the operator should turn on only the jam reset switch 165. Thereby, the finishing processing is resumed with the next bin.

The control procedures in the second embodiment is basically similar to those of the first embodiment. However, the bin transport subroutine, the sheet take-out subroutine, the stapling subroutine and the Jam reset subroutine are modified as shown in FIG. 26 (step S214), FIGS. 27*a* and 27*b* (step S215), FIG. 28 and FIG. 29 respectively.

In the sheet take-out subroutine (refer to FIGS. 27*a* and 27*b*), when a trouble occurs during the transportation of sheets from one of the bins 60 onto the staple tray 91 ("YES" at step S300), the jam flag is set to "1" to discontinue the operation of the sorter-finisher 40 (refer to steps S301 and S302), which is the same as the first embodiment. In the jam reset subroutine shown in FIG. 29, when a turning-on of the retry switch 166 is confirmed at step S321, a retry flag is set to "1" at step S322. Thereafter, when the jam reset switch 165 is judged on-edge, the jam flag is reset to "1". The retry flag works to determine which bin the finishing processing is resumed with after the recovery from a paper jam. When the retry switch 166 is pressed, the retry flag is set to "1", thereby resuming the finishing processing with the bin where the paper jam occurred. However, when the retry switch 166 is not pressed, the retry flag is kept "0", thereby resuming the finishing processing with the next bin.

Therefore, when the retry flag is "1", in the bin transport subroutine shown in FIG. 26, the result at step S220*a* is "YES", and the processing to move the next bin to the sheet take-out position X3 is omitted. Then, the processing at steps S215 and S216 is carried out toward the bin which is currently at the sheet take-out position X3, which is the bin where the paper jam occurred. On the other hand, when the retry switch 166 is not pressed, the result at step S220*a* is "NO", and the processing at steps S214, S215 and S216 is carried out toward the next bin. The processing in this case is the same as the first embodiment.

As mentioned above, when the finishing processing is to be resumed with the bin where the paper jam occurred, there is no need of moving the bin to the sheet take-out position X3. In this case, in the sheet take-out subroutine shown in FIG. 27*a*, when the direction-of-rotation sensor Se2 of the fixed cams 70 is not judged on-edge at step S241, at step S241*a* the retry flag is checked whether "1" or not. When the retry flag is "0", the processing goes to step S244. When the retry flag is "1", it is checked at step S241*b* whether a pinch roller solenoid timer has started, that is, whether or not the pinch roller solenoid has been already turned on. When the timer has not started yet, the processing goes to step S242 and then S243. When it has started, the processing goes to step S244. When the direction-of-rotation sensor Se2 of the fixed cams 70 is not judged on-edge at step S244, at step S244*a* the retry flag is checked whether "1" or not. When it is "0", the processing goes to step S246. When it is "1", it is checked at step S244*b* whether the jam detection timer has started, that is, whether or not the sheet take-out motor has been turned on. When the timer has not started yet, the processing goes to step S245 and then S246, and when it has already started, the processing goes to step S246.

In the stapling subroutine shown in FIG. 28, after a stapling operation is completed, the retry flag is checked whether "1" or not at step S265. When it is "1", at step S266 it is reset to "0".

Third Embodiment: Refer to FIGS. 30 and 31

In the third embodiment, as shown in FIG. 30, each of the bins 60 is provided with a reflective type photosensor Se10 to detect the presence or the absence or sheets in each bin 60 so that it can be automatically judged whether the finishing processing is to be resumed with the bin where a paper jam occurred or with the next bin. Since the determination on which bin the finishing processing is resumed with depends on the detection of sheets by the photosensor Se10, the retry switch 166 is not necessary any more.

The control procedures are basically similar to those of the second embodiment. However, the jam reset subroutine is modified as shown in FIG. 31. At steps S330 through S332, the operation of the sorter-finisher 40 is discontinued on the occurrence of a paper jam. Then, the presence of sheets in the bin where the paper jam occurred is checked at step S33 by the on/off state of the sensor Se10. When there are sheets in the bin, the retry flag is set to "1" at step S334. Then, it is determined whether the finishing processing is resumed with the bin where the paper jam occurred or the next bin, according to the state of the retry flag.

Fourth Embodiment: Refer to FIG. 32

In the fourth embodiment, each of the bins 60 is provided with the photosensor Se10 to detect the presence or the absence of sheets as in the third embodiment. The photosensors Se10 detect the presence or the absence of sheets all times, whether a paper jam occurs or not. If there are no sheets in one of the bins 60, which may be caused by the discharge of sheets from the bin 60 by an operator, the finishing processing toward the empty bin is omitted, and the next bin is subjected to the finishing processing immediately.

The control procedures are basically similar to those of the first embodiment. However, the sheet take-out subroutine to be executed at step S215 is modified as shown in FIG. 32. In the sheet take-out subroutine, the presence of sheets in each bin 60 is judged at step S240*a* from the state of the sensor Se10. When the sensor Se10 detects no sheets, the sheet take-out processing toward the bin is omitted, and the finishing processing toward the next bin is prepared at step S214, S215 and S216 (refer to the description in the first embodiment). The jam detection processing toward the empty bin is also omitted (refer to steps S245*a*, S248 and S300), and an alarm of a paper jam is never given in such a case.

Although the present invention has been described in connection with the preferred embodiments thereof, it is to be noted that various changes and modifications are apparent to those who are skilled in the art. Such changes and modifications are to be understood as included within the scope of the present invention as defined by the appended claims, unless they depart therefrom.

Further, in each of the embodiments, size of sheets which is able to be subjected to stapling operations is limited to A4 and B5 sizes, but such a limitation is given differently. Also, in the embodiments, sheets are stapled by the electric stapler during the finishing processing, but other ways of processing such as stapling sheets by clips, punching sheets, making a booklet with a cover, stamping sheets with letters or marks, coloring sheets partly on the size ends to be used as a index, etc. are available.

The jam reset switch 165 in the second and third embodiments can be disposed at a place other than on the panel 150. It is also possible that a switch which is turned on and off according to the open/closed state of the door of the sorter-finisher is used as a jam reset switch. Furthermore, in the third and fourth embodiments, it is not always necessary to provide a sensor Se10 for every bin 60. For example, a sensor may be installed in the sheet take-out position X3 to check the presence of sheets in each bin 60 which reaches the sheet take-out position X3.

What is claimed is:

1. A sorter having finishing function, which comprises:

a plurality of bins for receiving sheets;

means for distributing sheets ejected from an image forming apparatus among the plurality of bins;

means for finishing the sheets delivered to each of the bins;

means for transporting the sheets from each bin to the finishing means in a predetermined order;

means for judging the occurrence of a trouble during the transportation of the sheets from each bin to the finishing means;

means for discontinuing the operation of at least the transporting means when the occurrence of a trouble is judged;

means for commanding the resumption of the transporting operation by the transporting means;

means for selecting either a first mode where the transporting operation is resumed with the bin next to the bin where the trouble occurred during the sheet transportation, or a second mode where the transporting operation is resumed with the bin where the trouble occurred during the sheet transportation; and control means for, when the resumption command is generated, resuming the transporting operation in the first mode of the second mode according to the selection of the selecting means.

2. A sorter having a finishing function as claimed in claim 1, further comprising means for detecting the existence of sheets in the bin where the trouble occurred during the sheet transportation;

wherein the operation mode of the control means depends on the output of the sheet detecting means.

3. A sorter having a finishing function as claimed in claim 2, wherein the control means controls the first mode when no sheets are detected in the bin where the trouble occurred during the sheet transportation, and the control means operates the second mode when sheets are detected in the bin where the trouble occurred during the sheet transportation.

4. A sorter having a finishing function, which comprises:

a plurality of bins in which sheets ejected from an image forming apparatus are stored;

means for distributing the sheets among the bins;

means for stapling the sheets;

means for transporting the sheets from each bin to the stapling means in a predetermined order;

means for detecting the occurrence of a trouble during the transportation of the sheets from each bin to the stapling means;

means for resetting the transport trouble detecting means; and control means for, after the reset means is actuated, resuming the transporting operation with the bin next to the bin where the trouble occurred during the sheet transportation.

5. A sorter having finishing function as claimed in claim 4, wherein the stapling means has a tray for receiving sheets transported by the transporting means, on which the sheets are stapled.

6. A sorter having a finishing function, which comprises:

a plurality of bins in which sheets ejected from an image forming apparatus are stored;

means for distributing the sheets among the bins;

means for stapling the sheets;

means for transporting the sheets from each bin to the stapling means in a predetermined order;

means for detecting the occurrence of a trouble during the transportation of the sheets from each bin to the stapling means;

means for discontinuing the operation of the sorter when the occurrence of a trouble is detected;

means for resuming the operation of the sorter; and means for, when the operation of the sorter; and by the resuming means, determining whether the transporting operation is resumed with the bin next to the bin where the trouble occurred during the sheet transportation or with the bin where the trouble occurred during the sheet transportation.

7. A sorter having finishing function as claimed in claim 6, wherein the resuming means is a switch which is operated manually to reset the transport trouble detecting means.

8. A sorter having a finishing function as claimed in claim 6, wherein the determining means is a switch which is operated manually.

9. A sorter having a finishing function as claimed in claim 6, wherein the determining means includes means for detecting the existence of sheets in each bin, and when no sheets are detected in the bin where the trouble occurred during the sheet transportation, the determining means determines to resume the transporting operation with the next bin, and when sheets are detected in the bin where the trouble occurred during the sheet transportation, the determining means determines to resume the transporting operation with the bin.

10. A sorter having a finishing function as claimed in claim 9, wherein the sheet detecting means has sensors each of which is disposed in each bin.

11. A sorter having a finishing function, which comprises:

a plurality of bins in which sheets ejected from an image forming apparatus are stored;

means for distributing the sheets among the bins;

means for stapling the sheets;

means for transporting the sheets from each bin to the stapling means in a predetermined order;

means for detecting the existence or sheets in each bin;

means for switching bins to subject the next bin to the sheet transporting operation; and control means for controlling the bin switching means to skip the current bin and subject the next bin to the sheet transporting operation by executing the switching operation again when no sheets are detected in the next bin.

12. A sorter having a finishing function as claimed in claim 11, wherein the control means executes the switching operation without stapling operation.

13. A sorter having a finishing function as claimed in claim 11, wherein the control means executes the switching operation without transporting operation.

14. A sorter having a finishing function, which comprises:

means for distributing sheets ejected from an image forming apparatus among a plurality of bins;

means for finishing the sheets delivered to each of the bins;

means for transporting the sheets from each bin to the finishing means in a predetermined order;

means for detecting the occurrence of a trouble during the transportation of the sheets from each bin to the finishing means;

means for discontinuing the operation of the transporting means when the occurrence of a trouble is detected;

means for commanding the resumption of the transporting operation by the transporting means;

means for detecting the existence of sheets in each bin; and control means for, when the resumption command is generated, resuming the transporting operation with one of the bins in which sheets are detected by the sheet detecting means.

15. A sorter having a finishing function, which comprises:

a plurality of bins in which sheets ejected from an image forming apparatus are stored;

means for stapling the sheets;

means for transporting the sheets from each of the plurality of bins to the stapling means;

means for detecting the existence of sheets in each bin; and means for switching the transporting operation of the transporting means from a first bin of said plurality of bins to a second bin of said plurality of bins when no sheets are detected in the first bin.

16. A sorter having a finishing function, which comprises:

means for distributing sheets ejected from an image forming apparatus among a plurality of bins;

means for finishing the sheets delivered to each of the bins;

means for transporting the sheets from each bin to the finishing means in a predetermined order;

means for judging the occurrence of a trouble during the transportation of the sheets from each bin to the finishing means;

means for discontinuing the operation of at least the transporting means when the occurrence of a trouble is judged;

means for commanding the resumption of the transporting operation by the transporting means; and control means for, when the resumption command is generated, resuming the operation with the bin next to the bin where the trouble occurred during the sheet transportation.

* * * * *

UNITED STATES PATENT AND TRADEMARK OFFICE

CERTIFICATE OF CORRECTION

PATENT NO. : 5,106,067

DATED : April 21, 1992

INVENTOR(S) : Masahiro HIGAKI

It is certified that error appears in the above-identified patent and that said Letters Patent is hereby corrected as shown below:

In column 21, line 1, between "having" and "finishing" insert -- a --.

In column 21, line 60, between "having" and "finishing" insert -- a --.

In column 22, line 10, delete "sorter; and" and insert
-- sorter is resumed --.

In column 22, line 16, between "having" and "finishing" insert -- a --.

In column 22, line 45, delete "or" and insert -- of --.

Signed and Sealed this

Third Day of August, 1993

*Attest:*

Michael K. Kirk

MICHAEL K. KIRK

*Attesting Officer*

*Acting Commissioner of Patents and Trademarks*